US005364745A

United States Patent [19]

Mooberry et al.

[11] Patent Number: 5,364,745

[45] Date of Patent: Nov. 15, 1994

[54] AZOANILINE MASKING COUPLERS FOR PHOTOGRAPHIC MATERIALS

[75] Inventors: Jared B. Mooberry, Rochester; Stephen P. Singer, Spenceport; James J. Seifert; Robert J. Ross, both of Rochester; Daniel L. Kapp, Rochester, all of N.Y.

[73] Assignee: Eastman Kodak Company, Rochester, N.Y.

[21] Appl. No.: 778,828

[22] PCT Filed: Dec. 19, 1991

[86] PCT No.: PCT/US91/09640

§ 371 Date: Dec. 19, 1991

§ 102(e) Date: Dec. 19, 1991

[87] PCT Pub. No.: WO92/11575

PCT Pub. Date: Jul. 9, 1992

Related U.S. Application Data

[63] Continuation-in-part of Ser. No. 629,870, Dec. 19, 1990, abandoned.

[51] Int. Cl.[5] ..... G03C 5/54; G03C 7/18; G03C 7/32; G03C 7/34

[52] U.S. Cl. ..... 430/359; 430/226; 430/504; 430/549; 430/562; 430/958

[58] Field of Search ..... 430/226, 359, 549, 562, 430/958, 504

[56] References Cited

U.S. PATENT DOCUMENTS

| | | | |
|---|---|---|---|
| 2,367,531 | 1/1945 | Salminen et al. | 95/6 |
| 2,423,730 | 7/1947 | Salminen et al. | 260/559 |
| 2,428,054 | 9/1847 | Vittum et al. | 95/2 |
| 2,474,293 | 6/1949 | Weissberger et al. | 95/6 |
| 2,772,162 | 11/1954 | Salminen et al. | 96/55 |
| 2,852,370 | 9/1958 | Whitmore | 96/9 |
| 2,860,974 | 11/1958 | Williams | 96/9 |
| 2,895,826 | 7/1959 | Salminen et al. | 96/55 |
| 3,002,836 | 4/1959 | Vittum | 96/55 |
| 3,034,892 | 5/1962 | Gledhill et al. | 96/55 |
| 3,041,236 | 6/1962 | Stecker | 167/31 |
| 3,227,550 | 1/1966 | Whitemore et al. | 96/3 |
| 4,029,503 | 6/1977 | Fujiwhara et al. | 96/29 |
| 4,141,730 | 2/1979 | Minagawa et al. | 96/9 |
| 4,248,962 | 2/1981 | Lau | 430/382 |
| 4,333,999 | 6/1982 | Lau | 430/17 |
| 4,358,525 | 11/1982 | Mooberry et al. | 430/217 |
| 4,362,806 | 12/1982 | Whitmore | 430/402 |
| 4,409,323 | 10/1983 | Sato et al. | 430/544 |
| 4,420,556 | 12/1983 | Booms et al. | 430/549 |
| 4,439,513 | 3/1984 | Sato et al. | 430/203 |
| 4,439,520 | 3/1984 | Kofron et al. | 430/434 |
| 4,458,012 | 7/1984 | Ito et al. | 430/549 |
| 4,482,629 | 11/1984 | Nakagawa et al. | 430/542 |
| 4,483,914 | 11/1984 | Naito et al. | 430/203 |
| 4,554,243 | 11/1985 | Ono et al. | 430/543 |
| 4,647,527 | 3/1987 | Ikenoue et al. | 430/505 |
| 4,690,885 | 9/1987 | Yagihara et al. | 430/212 |
| 4,690,888 | 9/1987 | Fujiwhara et al. | 430/549 |
| 4,749,641 | 6/1988 | Kaufman et al. | 430/359 |
| 4,770,980 | 9/1988 | Matejec et al. | 430/502 |
| 4,840,884 | 6/1989 | Mooberry et al. | 430/557 |
| 5,019,492 | 5/1991 | Buchanan et al. | 430/543 |
| 5,112,730 | 5/1992 | Ohkawa et al. | 430/359 |
| 5,151,343 | 9/1992 | Begley et al. | 430/544 |

FOREIGN PATENT DOCUMENTS

| | | |
|---|---|---|
| 255085 | 8/1981 | European Pat. Off. . |
| 63-202745 | 8/1988 | Japan . |
| 2036994 | 7/1980 | United Kingdom . |
| 2105482 | 3/1983 | United Kingdom . |

OTHER PUBLICATIONS

*Research Disclosure*, Dec. 1989, Item 308119. Published by Kenneth Mason Publications Ltd., P010 7DQ, U.K.

*Primary Examiner*—Richard L. Schilling

*Attorney, Agent, or Firm*—Arthur E. Kluegel

[57] ABSTRACT

A photographic element including a support bearing a silver halide photographic emulsion, at least one color-forming coupler and a masking coupler, wherein said masking coupler is represented by the formula A:

COUP—LINK—DYE (A)

wherein COUP is a coupler moiety;

LINK is any group releasable or cleavable from COUP by coupling with an oxidized developing agent during photographic processing; and DYE is an azoaniline dye and preferably an azoaniline dye blocked at the nitrogen-inclusive auxochromic site.

32 Claims, 3 Drawing Sheets

AZOANILINE MASKING COUPLERS FOR PHOTOGRAPHIC MATERIALS

This is a continuation-in-part of U.S. patent application Ser. No. 629,870, filed Dec. 19, 1990, now abandoned.

BACKGROUND OF THE INVENTION

The present invention relates to masking couplers formed from conventional image-producing coupler moieties for color photographic materials. In particular, it relates to masking couplers using azo dyes to supply color to the masking coupler. The masking couplers may be blocked or unblocked.

It is well known that in a color photographic system, a color reproduction method based on the subtractive color process system usually employs cyan, magenta and yellow negative dye images. These dye images are formed when color-forming couplers undergo a coupling reaction with the oxidation product of a color developing agent such as a primary aromatic amine.

The dyes employed in such a system, however, are known to be inefficient with respect to transmitting all of the electromagnetic radiation expected from theoretical considerations. That is to say, a dye which is capable of absorbing radiation in a given region of the spectrum should ideally transmit radiation in all other regions of the spectrum, practical experience shows that such expectations are not realized. For example, a cyan dye is expected to absorb radiation in the red region of the visible spectrum and to transmit radiation in the green and blue regions. In reality, cyan dyes also absorb some radiation in both the green and blue regions of the electromagnetic spectrum. The magenta dye should absorb only green light but, in practice, also absorbs some blue and a small amount of red. The yellow dye is closer to theory, and its unwanted absorptions of green and red light are small. The result of this unwanted side-absorption is distortion in the color reproduction of color photographic materials.

To correct this problem of side-absorption, a masking technique is employed whereby the effect of the undesired side-absorption is canceled out. As described for example in U.S. Pat. No. 2,428,054, and in "The Theory of the Photographic Process", 4th Ed., T. H. James, Macmillan Publishing Co., Inc., New York (1977), pp. 571–574, the conventional masking technique for use with a cyan dye is to employ a colored cyan dye forming coupler, i.e., a masking coupler, which is colored as coated in a photographic element (yellow, and/or magenta) so that it has an absorption in the blue and/or green region. Upon reaction of the masking coupler in exposed areas with oxidized color developing agent, the original yellow and/or magenta color of the masking coupler is eliminated as the cyan dye is formed. The net result of combining the cyan masking coupler and the cyan image coupler is to have the equivalent amounts of blue and/or green density in both the exposed and unexposed areas thus "masking" or effectively removing the effects of the unwanted absorbance of the cyan dyes.

A colored masking coupler should exhibit desirable hue properties such as a narrow bandwidth of absorption and a high level of extinction. In addition, a masking coupler should have good reactivity towards the oxidized color developing agent and solubilization and surfactant properties.

A problem arising from the use of masking couplers which are colored when coated in the film is that the colored masking couplers absorb some of the light which should be absorbed by the silver halide crystals. U.S. Pat. No. 2,860,974 describes a method for alleviating this problem which utilizes a light-colored, non-image-forming colored coupler whose color is then shifted during processing to the desired characteristics for masking, thus avoiding light filtration effects during exposure. The use of color or hue shifting allows non- or low-colored materials to be coated which then become colored in the non-exposed or $D_{min}$ areas of the film only after processing. Hue-shifting can be accomplished using various known techniques for blocking and unblocking the dye chromophore or auxochrome as described, for example, in U.S. Pat. Nos. 4,690,885; 4,358,525 and 4,554,243, United Kingdom Patent Application No. 2,105,482.

The following colored azo dye structures are typical of conventional masking couplers:

Conventional Compound A

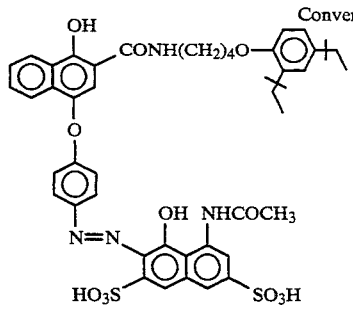

Conventional Compound B

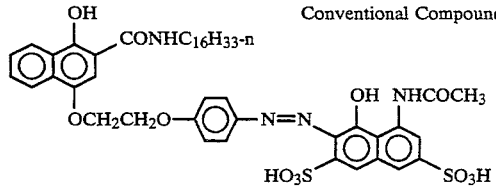

Conventional Compound C

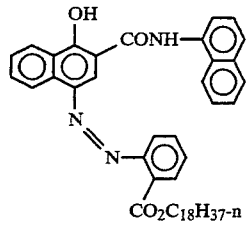

These masking couplers exhibit relatively low extinction levels, broad bandwidths, and limited hue shifting capability. For example, conventional compound A has a low extinction of 31,000 in acetone and undesirable surfactant properties arising from its strong acid ($SO_3H$) solubilization. Furthermore, it is very difficult to shift conventional compound A in a practical, easy-to-reproduce manner.

U.S. Pat. No. 4,840,884 discloses a coupler having a coupling-off group which is represented by the formula—L—$NR^1$—DYE, wherein L is a particular kind of linking group, $NR^1$ is a substituted nitrogen atom and DYE can be an azo dye. These couplers, however, generally are not useful as masking couplers because the azoaniline dye is shifted (lambda max<400 nm) due to the carbonyl linking group's direct attachment to the nitrogen atom. As a result, while these couplers are not significantly colored as coated, the residual couplers remain largely uncolored as well after processing and provide little of the desired color correction.

SUMMARY OF THE INVENTION

It is therefore an object of the present invention to provide a colored masking coupler having improved hue properties such as a higher level of extinction and a more narrow bandwidth and improved solubilization properties.

Another object of the present invention is to provide a blocked masking coupler which exhibits a large hue shift upon unblocking of the dye auxochrome during processing.

It also is an object of the present invention to provide a photographic color material which includes the above-mentioned improved masking coupler and a process of forming a photographic image which utilizes this masking coupler.

In accomplishing the foregoing objects there is provided according to the present invention a photographic element comprising a support bearing a silver halide photographic emulsion, at least one color-forming coupler and a masking coupler represented by the formula A:

COUP—LINK—DYE (A)

wherein COUP is a coupler moiety;

LINK is a group releasable or cleavable from COUP by coupling with an oxidized developing agent during photographic processing; and DYE is an azoaniline dye. Preferably, the masking coupler is a shifted azoaniline dye having a nitrogen-inclusive auxochromic site that is blocked and capable of being unshifted by unblocking. More preferably the site is blocked without substantially inactivating the coupling site.

Most preferably, masking couplers of formula A have a eneric chemical structure which may be represented by the formula B:

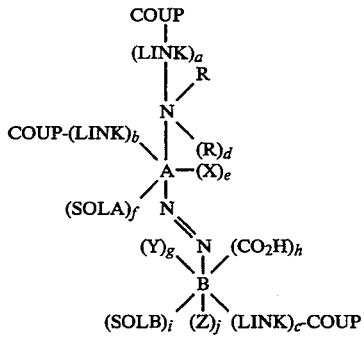

(B)

wherein a is 1 when b and c are 0, b is 2 when a and c are 0, or c is 1 when a and b are 0;

d, e, f, g, h, i, j may be 0 or 1;

A and B are the same or different and are an aromatic or heterocyclic group;

R is a hydrogen atom, a branched or unbranched, saturated or unsaturated hydrocarbon group, a heterocyclic group or an aromatic group;

X is an alkyl, hydroxy, alkoxy, alkyl carboxyl, amido, sulfonamido, aromatic or heterocyclic group or a halogen atom;

SOLA is a first solubilizing group;

SOLB is a second solubilizing group; and

Y and Z are the same or different and are selected from the group consisting of a halogen atom, an alkyl group, a hydroxy group, an alkoxy group, a carboxyl group, a cyano group; an amido group, a sulfonamido group, a sulfamoyl group, a sulfonyl group, a nitro group, a carboalkoxy group, a carbamoyl group and an acyl group.

There also is provided according to the present invention a photographic element wherein the above-identified masking coupler is coated with a cyan image dye-forming coupler in a red-sensitive photographic silver halide emulsion layer. In another embodiment of the present invention, the masking coupler is coated with a magenta image dye-forming coupler in a green-sensitive photographic silver halide emulsion layer.

In addition, there is provided according to the present invention a process of forming a photographic image which comprises developing an exposed silver halide emulsion layer with a color developing agent in the presence of the above-described masking coupler.

Further objects, features and advantages of the present invention will become apparent from the detailed description of preferred embodiments that follows.

DETAILED DESCRIPTION OF THE PREFERRED EMBODIMENTS

Figure 1:
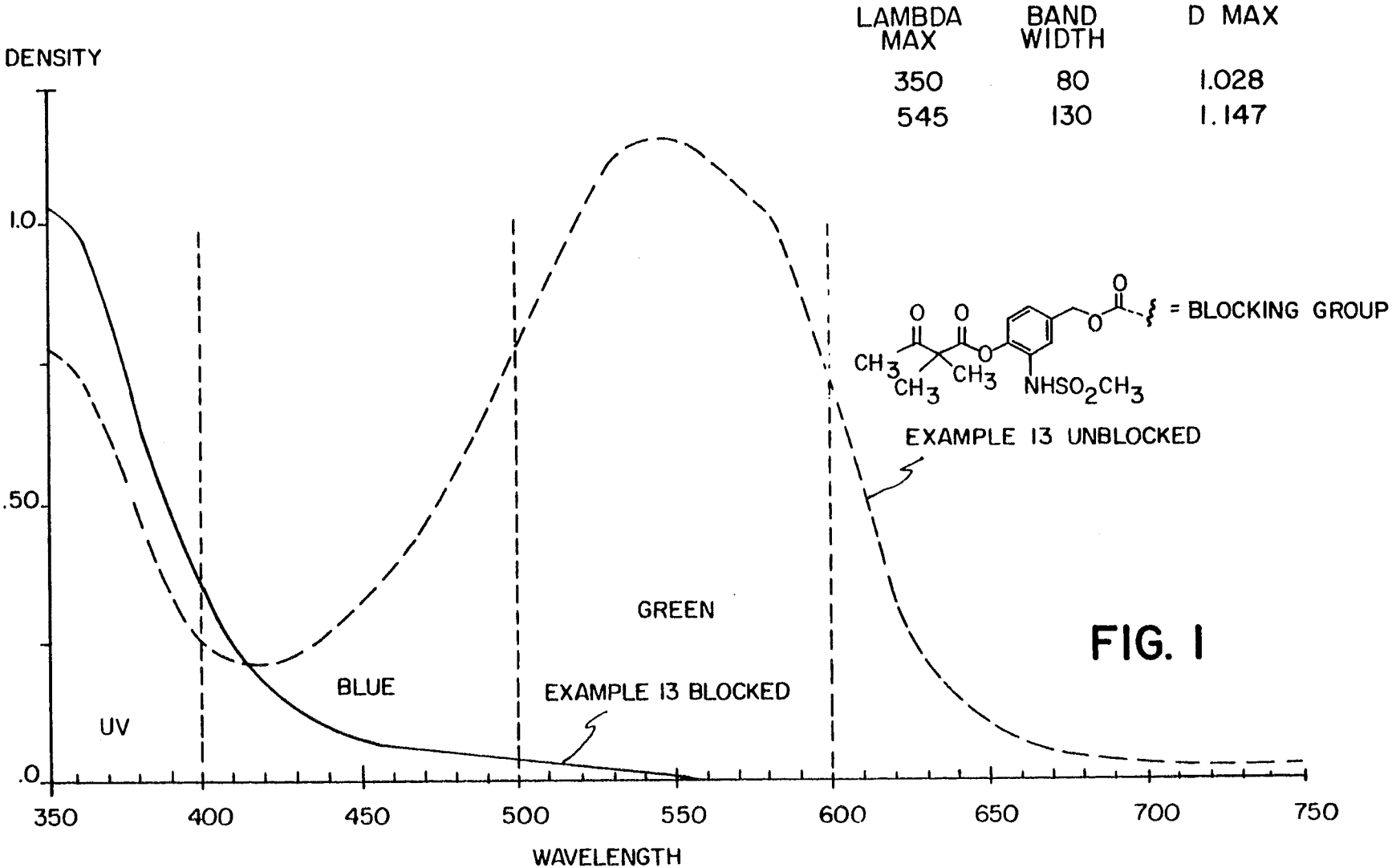
FIG. 1 is a graph representing the hue shifting upon unblocking of a magenta-colored masking coupler according to the present invention.

According to the present invention, an azoaniline dye is used for the first time to provide color to a masking coupler. In particular, attachment of an unblocked or unshifted azoaniline dye to a cyan, magenta, yellow or "universal" dye-forming coupler via a releasing linking group results in a magenta-, yellow- or cyan-colored masking coupler.

The unshifted colored masking coupler displays improved hue characteristics due in part to the nitrogen-inclusive auxochrome of the azoaniline dye chromophore. As used herein, the term chromophore means the color-forming portion of a molecule used in the dye or photographic art and as described in *Chemistry of Organic Compounds* by Carl R. Noller, pub. W. B. Sanders and Co., pages 618–619 (1952) and *The Theory of the Photographic Process,* 4th ed., edited by T. H. James, pub. Macmillan Publishing, pages 194–199 (1977). An auxochrome is a group that intensifies the color of the dye as described in *The Chemist's Companion* by A. Gordon and R. Ford, pub. John Wiley & Sons, pages 211–218 (1972).

Another advantage associated with the present masking coupler is that the nitrogen-inclusive auxochrome can be blocked by a group having an electrophilic center, such as a carbonyl group, and then unblocked during development. That is to say, the azoaniline dye is shifted in hue, and thus substantially colorless, when the blocking group is connected and then is unshifted to give the desired hue by removing the blocking group. Conventional blocking and shifting mechanisms, such as those described in UK Patent Application 2 105 482, can be employed in association with the present masking coupler; however, one example of a particularly effective blocking and shifting mechanism for use with the present masking coupler is described in detail in U.S. Pat. No. 5,019,492, which is incorporated by reference.

The blocking and shifting mechanism described in U.S. Pat. No. 5,019,492 utilizes a new blocking group that is capable of releasing a photographically useful group (PUG), such as the present masking coupler, upon processing of a photographic element which includes the present masking coupler. The blocking group comprises two electrophilic groups, the least electrophilic of which is bonded directly or through a timing group to the PUG; is capable of reacting with a dinucleophile; and, the two electrophilic groups are separated from each other by a bond or unsubstituted or substituted atom that enables a nucleophilic displacement reaction to occur with release of the PUG upon processing the photographic element in the presence of a dinucleophile reagent. Blocking groups particularly useful in connection with the present invention include the following:

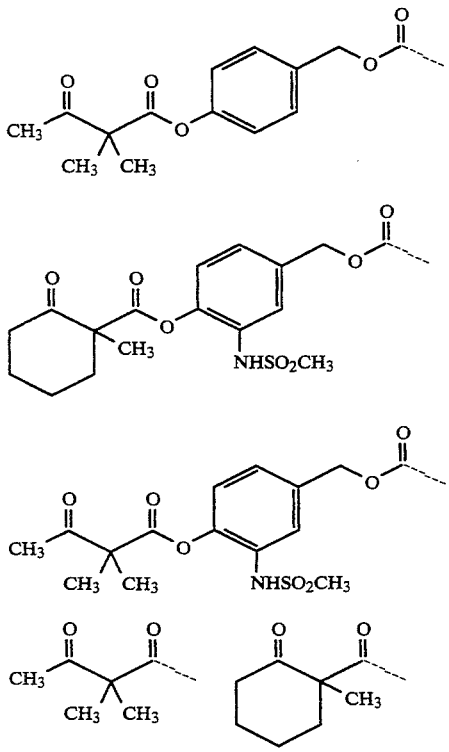

The azoaniline dye includes an auxochromic nitrogen positioned ortho or para to the azo functional group. The nitrogen-inclusive auxochrome must be overall electron-donating in order for the dye to have a useful hue. Preferably, the substituent R on the auxochromic nitrogen is an alkyl group or a hydrogen atom. In this context, alkyl groups generally are electron-donating and hydrogen atoms are neutral. The substituents and linking groups attached to the auxochromic nitrogen should not be electron-withdrawing groups such as carbonyl or sulfonyl groups.

The groups represented by A and B in formula B include aromatic groups such as a phenyl group and a napthyl group or heterocyclic groups such as, for example, a thienyl group, a furyl group, a pyrrolyl group, a pyridyl group, a benzothienyl group, an indolyl group, a thiazolyl group, a benzothiazolyl group and an oxazolyl group. The phenyl group is particularly preferred.

When the oxidized developing agent reacts with the colored masking coupler the azoaniline dye is released and washed out of the film during processing. In practice, the same batch of developing agent is used for processing numerous rolls of film and thus the concentration of the washed-out azoaniline dye gradually increases. This increased concentration of azoaniline dye in the developing agent may result in the re-entering of azoaniline dye into the film during development.

To prevent this and ensure that the washed-out azoaniline dye remains in the developing solution, solubilizing groups SOLA and SOLB can be attached to the dye moiety. In other words, the solubilizing groups SOLA and SOLB act to control the solubilization in water of the washed-out azoaniline dye. The solubilizing group should be sufficiently acidic so as to become substantially ionized at about pH 10, i.e., $pK_a \leqq 9$. Preferably, a carboxyl, sulfonic acid or low-$pK_a$ sulfonamide group is used as a solubilizing group.

The group represented by X in formula B typically is an electron-donating group and includes, for example, an alkyl group, a hydroxy group, an alkoxy group, an alkyl carboxyl group, an amido group, a sulfonamido group, an aromatic group, a heterocyclic group and a halogen atom.

The groups represented by Y and Z in formula B typically are election-withdrawing groups such as, for example, an alkyl group, a hydroxy group, an alkoxy group, a carboxyl group, a cyano group, an amido group, a sulfonamido group, a sulfamoyl group, a sulfonyl group, a nitro group, a carboalkoxy group, a carbamoyl group, an acyl group or a halogen atom.

In general, the hue and extinction level coefficient of the azoaniline dye are improved by the addition of substituents adjacent to the azo function which can hydrogen bond to the azo function. Most preferred as hydrogen-bonding substituents are carboxyl, amido or sulfonamido groups.

In the magenta-colored masking coupler according to the present invention the azoaniline dye preferably is a 4-nitrophenylazoaniline. The 4-nitro group serves as a strong electron-withdrawing group which is responsible in part for making the unshifted azoaniline dye magenta in color, i.e., lambda max approximately equals 550 nm. If the 4-nitro group is not present, the color of the dye moves towards the yellow region, i.e., lambda max approximately equals 450 nm.

The azoaniline dye generally cannot be attached to the coupling site of the coupler moiety directly through the auxochromic nitrogen because poor hue and coupling activity results. A linking group, also known in the photographic art as a timing group, is used to connect the azoaniline dye and coupler moiety so that reaction of the masking coupler and oxidized color developing agent causes the linking group and the azoaniline dye to cleave or release from the coupler moiety. The linking group preferably contains a heteroatom such as oxygen which is attached to the coupler moiety.

Upon reaction with oxidized developing agent, the linking group may be stable or unstable after reaction with the oxidized developing agent. Alternatively, the linking group may form part of the dye nucleus. In other words, the entire linking group or a portion thereof may or may not cleave from the dye.

Any timing group that is known in the photographic art is useful as the linking group between the coupler moiety and the azoaniline dye. Examples of useful timing groups are described in U.S. Pat. Nos. 4,248,962 and 4,409,323 and European Patent Application 255,085.

The particular timing groups employed, including the linkage by which they are attached to the azoaniline dye and the coupler moiety and the nature of the substituents on the timing group, can be varied to help control such parameters as rate and time of bond cleavage of the coupler moiety as well as diffusibility of the azoaniline dye.

The coupler moiety COUP can be any moiety which will react with oxidized color developing agent to cleave the bond between the linking group and the coupler moiety. It includes coupler moieties employed in conventional color-forming couplers which yield colorless products on reaction with oxidized color developing agents as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless.

The coupler moiety COUP in magenta-colored masking couplers preferably is a coupler which forms a cyan dye image upon reaction with oxidized developing agent. Preferred cyan dye-forming couplers are phenols and naphthols. Representative couplers are described in the following patents and publications: U.S. Pat. Nos. 2,367,531; 2,423,730; 2,474,293; 2,772,162; 2,895,826; 3,002,836; 3,034,892; 3,041,236; 4,333,999; and in "Farbkuppler—ein Literaturübersicht," published in Agfa Mitteilungen, Band III, pp. 156–175 (1961).

Structures of preferred cyan couplers include the following:

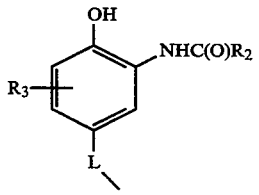

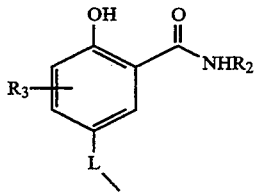

-continued

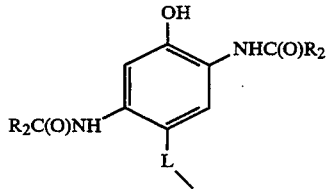

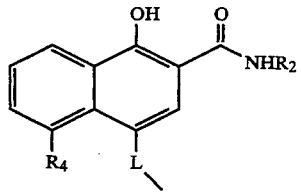

where $R_2$ represents a ballast group, $R_3$ represents one or more of halogen, alkyl or alkoxy groups, $R_4$ represents acyl amino (—NHCO—) or sulfonamido, and the linking group —L— is as defined above.

The coupler moiety COUP may also be a "universal" coupler such as described in U.S. Pat. No. 4,482,629. An example of which is a naphthol coupler represented by the following formula:

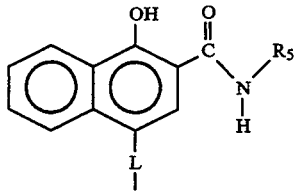

where $R_5$ represents a hydrogen atom or an alkyl, aryl or heterocyclic group. Preferred $R_5$ groups include H, $CH_3$, $—CH_2CH_2CO_2Et$ $—CH_2CH_2CO_2Me$ $—CH_2CH_2CO_2H$. Universal coupler moieties are particularly useful for yellow-colored masking couplers.

The masking couplers according to the present invention can be incorporated into photographic elements. Generally, the colored masking coupler according to the present invention is incorporated in a photographic element in same color layer in which the image coupler to be masked will form the negative image. For example, the masking coupler can be coated with a cyan image dye-forming coupler in a red-sensitive photographic silver halide emulsion layer. The masking coupler can also be coated with a magenta image dye-forming coupler in a green-sensitive photographic silver halide emulsion layer.

Photographic elements according to the invention can be processed by conventional techniques in which color forming couplers and color developing agents are incorporated in separate processing solutions or compositions or in the element itself.

Photographic elements in which the masking couplers according to the invention are incorporated can be simple elements comprising a support and a single silver halide emulsion layer, or they can be multilayer, multicolor elements. The masking couplers according to the invention can be incorporated in at least one of the silver halide emulsion layers and/or in at least one other layer, such as an adjacent layer, where they will come into reactive association with oxidized color developing agent which has developed silver halide in the emulsion layer. The silver halide emulsion layer can contain or have associated therewith other photographic coupler compounds, such as competing couplers. These other photographic couplers can form dyes of the same or different color and hue as the couplers according to the invention. In addition, the silver halide emulsion layers and other layers of the photographic element can contain other conventional additives.

A typical multilayer, multicolor photographic element can comprise a support having thereon a red-sensitive silver halide emulsion unit having associated therewith a cyan dye image-forming material, a green-sensitive silver halide emulsion unit having associated therewith a magenta dye image-forming material, and a blue-sensitive silver halide emulsion unit having associated therewith a yellow dye image-forming material. Each silver halide emulsion layer can comprise one or more layers. The various units and layers moreover can be arranged in different locations with respect to one another.

The photographic elements can be single color elements or multicolor elements. Multicolor elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders known to those skilled in the art. In an alternative format, the emulsions sensitive to each of the three primary regions of the spectrum can be disposed as a single segmented layer, e.g., as by the use of microvessels as described in Whitmore, U.S. Pat. No. 184,714, filed Sep. 8, 1980, now issued as U.S. Pat. No. 4,362,806.

A typical multicolor photographic element can also contain additional layers, such as filter layers, interlayers, overcoat layers, subbing layers and the like.

The light-sensitive silver halide emulsions can include coarse, regular or fine grain silver halide crystals or mixtures thereof. The silver halides employed in the present invention generally can comprise any light-sensitive silver halides known in the photographic art such as, for example, silver chloride, silver bromide, silver bromoiodide, silver chlorobromoidide and mixtures thereof. The emulsions can be negative-working or direct-positive. They can form latent images predominantly on the surface of the silver halide grains or predominantly on the interior of the silver halide grains. They can be chemically and spectrally sensitized. The emulsions typically will be gelatin emulsions although other hydrophilic colloids are also useful.

Tabular grain silver halide emulsions can also be utilized in the photographic element of the present invention. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520.

Preferably, the masking couplers according to the invention are incorporated in silver halide emulsions and the emulsions coated on a support to form a photographic element. Alternatively, the inventive masking couplers can be incorporated in photographic elements adjacent the silver halide emulsion where, during development, the masking coupler will be in reactive association with development products such as oxidized color developing agent. Thus, as used herein, the term "associated therewith" signifies that the masking coupler is in a silver halide emulsion layer or in an adjacent location where, during processing, it will come into reactive association with silver halide development products.

The support can be any support used with photographic elements. Typical supports include cellulose nitrate film, cellulose acetate film, polyvinylacetal film, polyethylene terephthalate film, polycarbonate film and related films or resinous materials, as well as glass, paper, metal and the like. Typically, a flexible support is employed, such as a polymeric film or paper support. Paper supports can be acetylated or coated with baryta and/or and $\alpha$-olefin polymer, particularly a polymer of an $\alpha$-olefin containing 2 to 10 carbon atoms such as polyethylene, polypropylene, ethylene-butene copolymers and the like.

In the following discussion of suitable materials for use in the emulsions and elements according to the invention, reference will be made to *Research Disclosure,* December 1989, Item 308119, published by Kenneth Mason Publications Ltd., Elmsworth, Hampshire P010 7DQ, U.K., the disclosures of which are incorporated in their entireties herein by reference. This publication will be identified hereafter as "Research Disclosure".

The silver halide emulsions employed in the elements according to the invention can be either negative-working or positive-working. Suitable emulsions and their preparation are described in Research Disclosure Sections I and II and the publications cited therein. Suitable vehicles for the emulsion layers and other layers of elements according to the invention are described in Research Disclosure Section IX and the publications cited therein.

In addition to the masking couplers according to the invention, the elements according to the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements according to the invention, or individual layers thereof, can contain brighteners (see Research Disclosure Section V), antifoggants and stabilizers (see Research Disclosure Section VI), antistain agents and image dye stabilizers (see Research Disclosure Section VII, paragraphs I and J), light-absorbing and scattering materials (see Research Disclosure Section VIII), hardeners (see Research Disclosure Section X), plasticizers and lubricants (see Research Disclosure Section XII), antistatic agents (see Research Disclosure Section XIII), matting agents (see Research Disclosure Section XVI), and development modifiers (see Research Disclosure Section XXI).

The photographic elements according to the invention can be coated on a variety of supports as described in Research Disclosure Section XVII and the references cited therein.

Photographic elements can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethylaniline hydrochloride, 4-amino-3-methyl-N,N-diethylaniline hydrochloride, 4-amino-3-methyl-N-ethyl-N-β-(methanesulfonamido)ethylaniline sulfate hydrate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative-working silver halide this processing step leads to a negative image. To obtain a positive (or reversal) image, this step can be preceded by development with a non-chromogenic developing agent to develop exposed silver halide, but not form dye, then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying.

Masking couplers according to the present invention can be prepared by methods known in the organic synthesis arts. Typically, the masking couplers of the present invention are prepared according to the following exemplary scheme:

COMPOUND 1

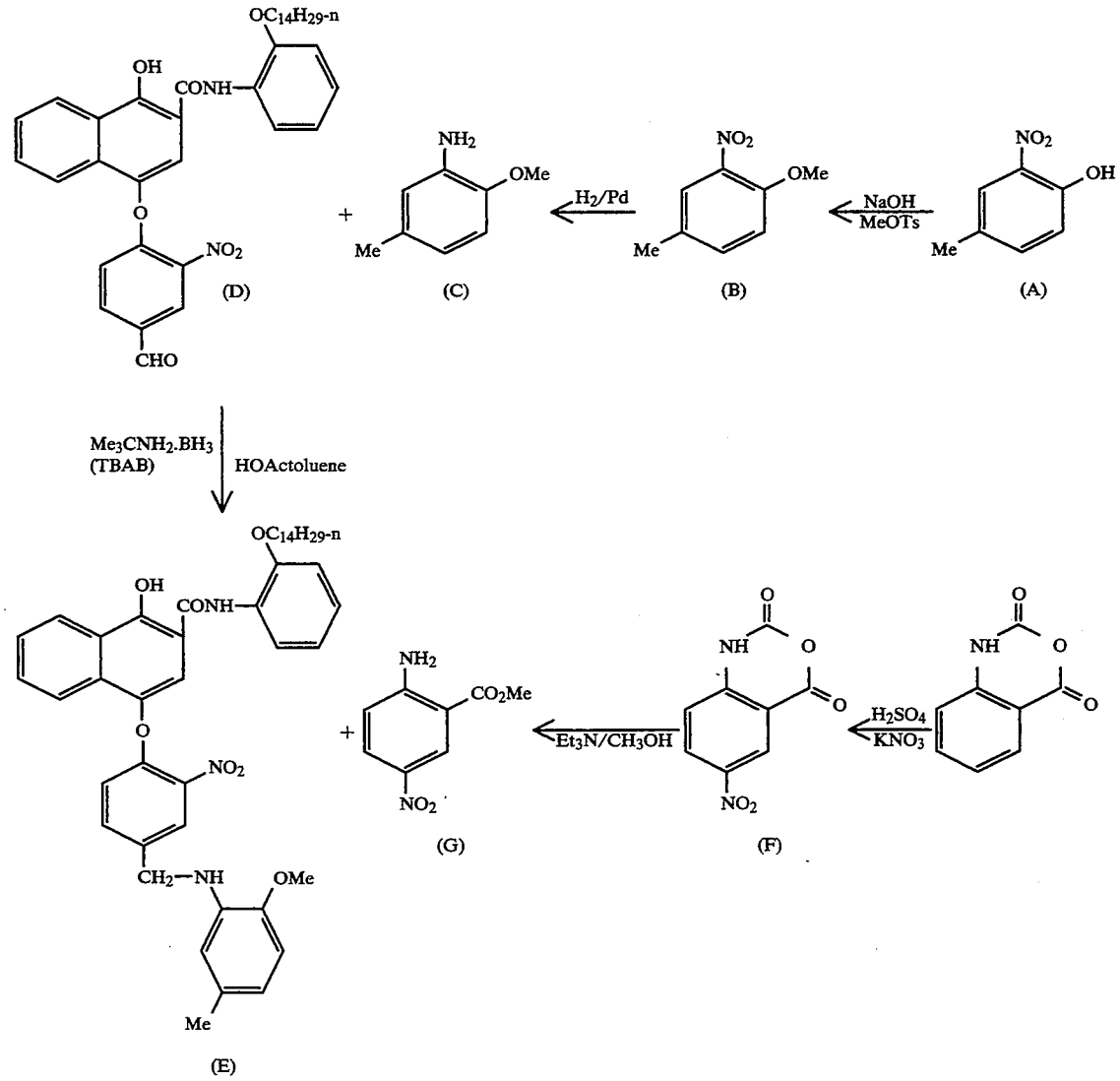

-continued

COMPOUND 1

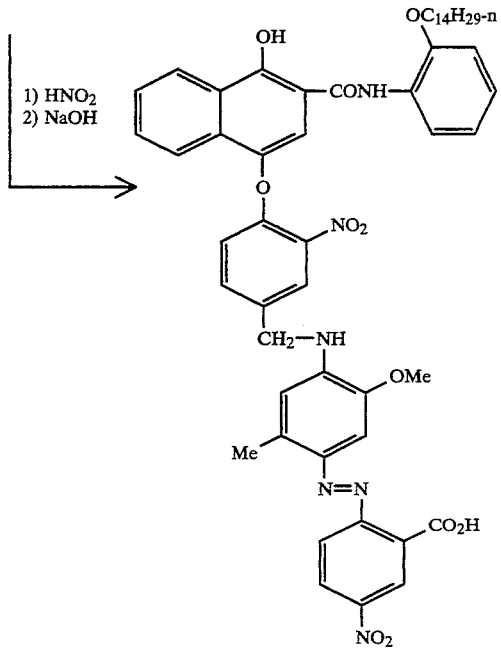

DMF, THF, EtOAc and HOAc herein are dimethylformamide, tetrahydrofuran, ethyl acetate and acetic acid, respectively. Et herein means $C_2H_5$—. Me herein means $CH_3$—. Temperatures herein are °C. unless otherwise indicated. RT herein means room temperature.

The synthesis of azoaniline masking coupler (Example 1) proceeded by alkylating 2-nitro-4-methylphenol (A) (Aldrich, MW153, 100 g, 0.65 mole) in 400 ml DMF with NaOH (50% aq. solution, 65 g, 0.8 mole) and methyltoluenesulfonate (Kodak, MW186, 140 ml). The mixture was stirred at RT for 2 days and then heated at 60° for 30 min. Aqueous ammonium hydroxide (100 ml) was added to the cooled mixture before stirring for 4 hours. The mixture was diluted with $Et_2O$/heptane, washed with aq. $Na_2CO_3$ and $H_2O$, dried over $MgSO_4$, and concentrated to 101 g(93%) of (B).

Nitroanisole (B) (47 g, 0.28 mole) was hydrogenated (40 psi $H_2$/Pd/C,205 ml of THF, 3 ml of HOAc, and 3 drops of 2N HCl) for 68 hrs. The catalyst was filtered off and the filtrate was diluted with 1:1 $Et_2O$: heptane (500 ml). The mixture was washed with aq. $NH_3$, dried, and concentrated to solid (C) (38.1 g, 98%).

Coupler (D) can be prepared according to the following scheme:

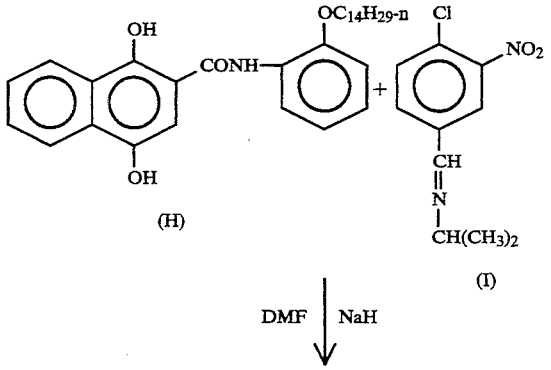

-continued

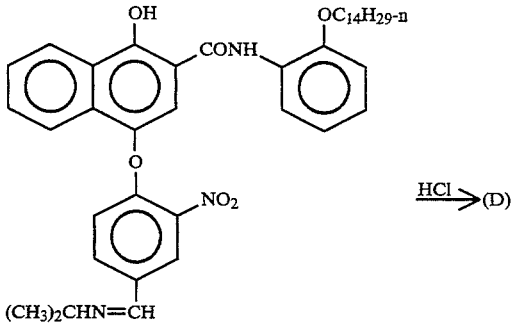

(J)

Coupler (H) can be prepared by methods known in the organic synthesis arts. A solution of 4-chloro-3-nitrobenzaldehyde (11.1 g, 60 mmole) and isopropylamine (5.3 g, 90 mmole) in 150 ml methanol was refluxed for 30 min. The solvent was distilled off and the crude Schiff base (I) solidified on drying in vacuo for 18 hr. It was dissolved in 150 ml DMF and added dropwise at approximately 5° during 30 min. to a solution of (H) dianion, prepared by adding a solution of (H) (24.5 g, 50 mmole) in 70 ml DMF to a suspension of hexane-washed 50% sodium hydride (4.8 g, 100 mmole) in 150 ml DMF at 5°. The reaction mixture was stirred at RT for 3 hr, diluted with 400 ml of ethyl acetate and washed twice with dilute hydrochloric acid. The aqueous washes were reextracted with ethyl acetate. Combined ethyl acetate solutions were washed with saturated solution of sodium chloride, dried over magnesium sulfate and evaporated to a solid. The crude product was slurried in 200 ml of isopropanolheptane (1:3) and the product collected by filtration, washed with the above followed by heptane, and dried for 18 hr in vacuo. The yield of coupler (D) was 23.7 g (74%).

Coupler (D) (MW640, 68 g, 0.106 mole) was mixed with anisidine (C) (MW 137, 28.7 g, 0.21 mole) in 100 ml; of toluene, heated at 50° with a warm water bath for about 15 min., cooled to RT, and diluted with 150 ml of HOAc. t-Butylaminoborane (Eastman, MW87, 11.4 g, 0.131 mole) was added slowly over 5 min. before stirring the mixture at RT for 30 min. Methanol (700 ml) and water (25 ml) were added, the mixture was seeded, and product crystallized at RT over about 15 min. Coupler (E) was filtered off and dried to 76 g (94%).

Diazonium component (F), 5-nitroisatoic anhydride, is commercially available but expensive. It is prepared easily by carefully (15 min.) dissolving isatoic anhydride (MW 163, 163 g, 1.0 mole) in 1 L of conc. $H_2SO_4$in a 5 L flask equipped with mechanical stirring and kept at 10°-15° with an ice bath. Potassiumnitrate (MW101,101 g, 1.0 mole) was slowly added over 20 min while controlling the temperature below 25° and stirring vigorously. Nitration was complete a few minutes after addition of $KNO_3$ was complete; TLC using 1:1 EtOAc:-heptane showed conversion to a less mobile non-fluorescent material. The reaction mixture was carefully poured onto 4 L of ice in a 3 gal stainless steel bucket while adding just enough additional ice to keep the aqueous solution at 0°. The precipitated nitroisatoic anhydride was filtered (6 L sintered glass funnel), washed with water, slurried in 500 ml $CH_3CN$, filtered, washed with 1 L of $Et_2O$, and air dried to 174 g (84%) of pale yellow solid (F).

The anhydride (F) (MW208, 104 g, 0.5 mole) was mixed with THF (200 ml), MeOH (600 ml), and triethylamine (25 ml) in a 5 L wide-mouthed flask equipped with mechanical stirrer. The mixture was warmed gently with a steambath until vigorous evolution of $CO_2$ commenced and then subsided. The mixture was then heated to reflux for 5 min., cooled to RT, stirred 2 hr while product precipitated, diluted with 500 ml of water, and stirred 1 hr. After filtering, washing with water, and air drying, 90.6 g (92%) of the ester (G) was obtained.

Nitroester (G) (MW 196, 6.5 g, 0.033 mole) was dissolved in a mixture of THF (65 ml), HOAc (15 ml), $H_2O$ (10 ml;), and $MeSO_3H$ (15 ml) and cooled to 0° . After the addition of $NaNO_2$ (MW 69, 2.3 g, 0.033 mole), the cold diazonium solution was stirred at 0° for 1 hr. The diazonium solution was kept cold while being added slowly over a few minutes to a vigorously stirred cold (0°) solution of coupler (E) (MW 762 25.1 g, 0.033 mole) in 75 ml of THF plus 25 ml of HOAc. Sodium acetate (MW 84, 7 g, 0.033 mole) was added and the mixture was allowed to stir at 0° for 30 min. before warming to RT. The dye was precipitated by adding 500 ml of $H_2O$, stirring a few minutes, then filtering. The crude cake was redissolved in about 200 ml of THF/100 ml of HOAc, warmed to 40°-50° for 10 min. to complete rearrangement of the triazene, diluted with about 300 ml of water, and filtered again. The product was slurried in MeOH, filtered, and air dried to form 30.6 g (95%) of an intermediate ester product.

A portion of the intermediate ester product (MW 967, 5 g, 0.052 mole) was mixed with 30 ml of THF, 25 ml of MeOH, and 26 ml of 1N NaOH and stirred at RT for about 35 min. until TLC (5:4:1 $CH_2Cl_2$:heptane:EtOAc ) showed hydrolysis to an immobile product to be complete. The mixture was acidified with 1N HCl, stirred 10 min., and filtered to collect the crude product. Purified masking coupler Example 1 (2.4 g, 50%) was obtained by slurrying the crude in hot $CH_3CN$, cooling, filtering, and drying.

The following examples can also be prepared using the described procedures of synthesis:

2.

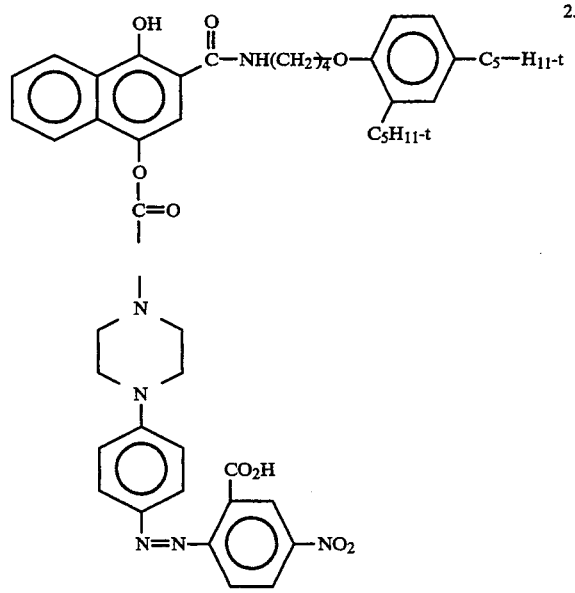

3.

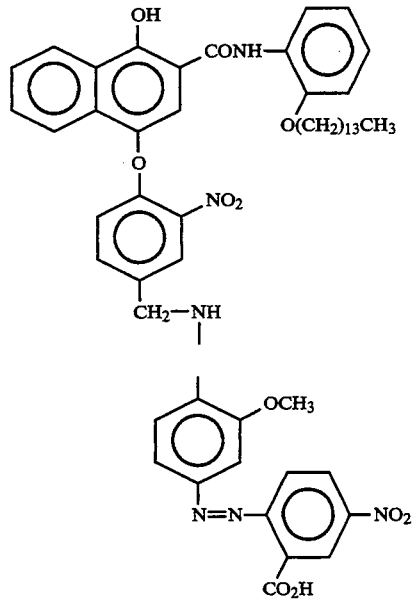

4.

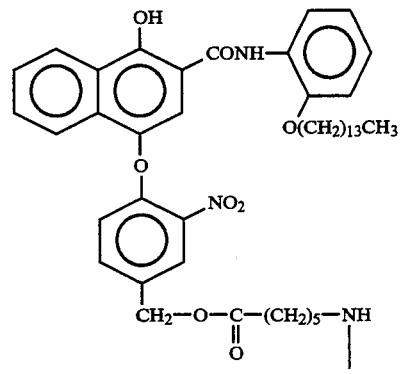

-continued
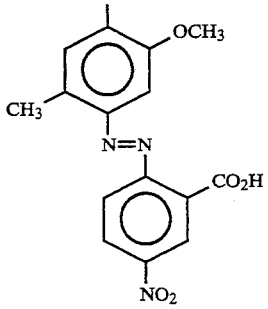
5.
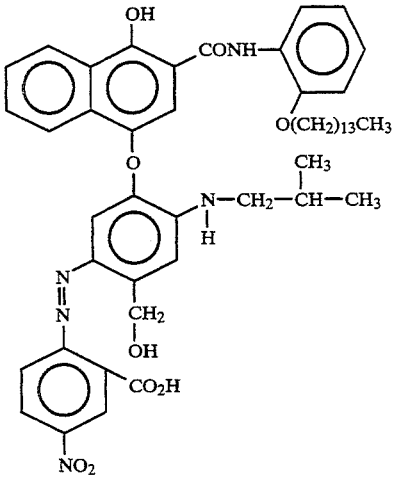
6.
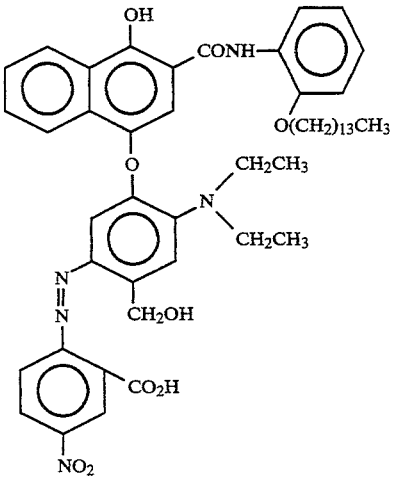
-continued
7.
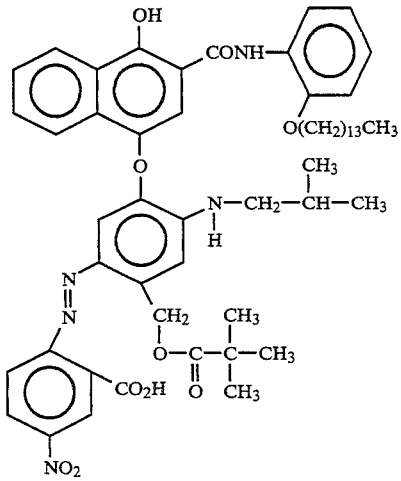
8.
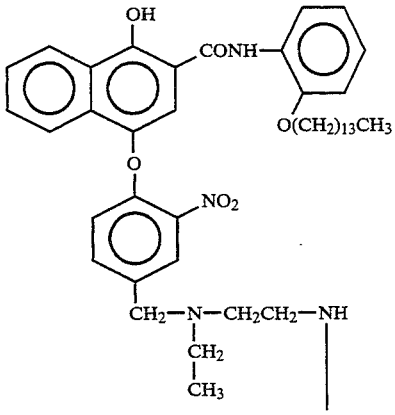
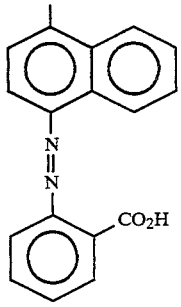
9.
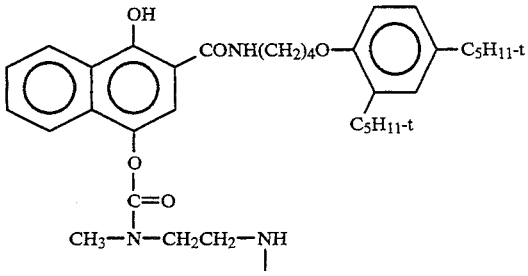

-continued
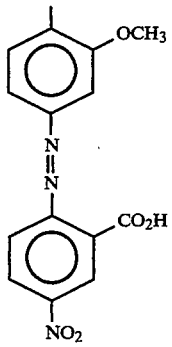
10.
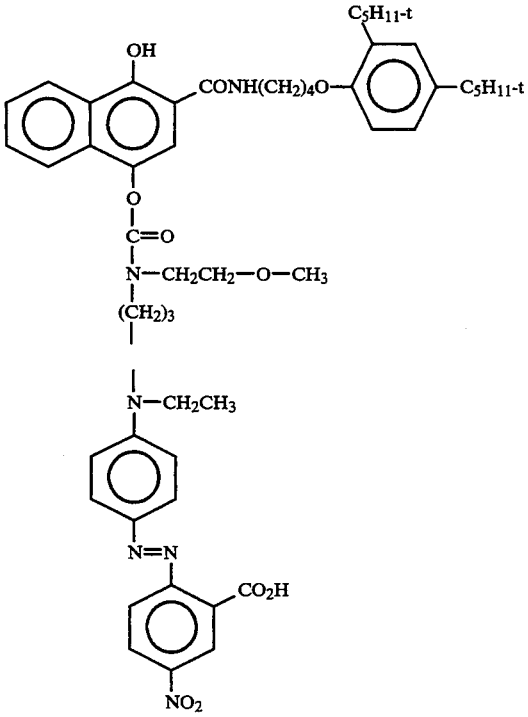
11.
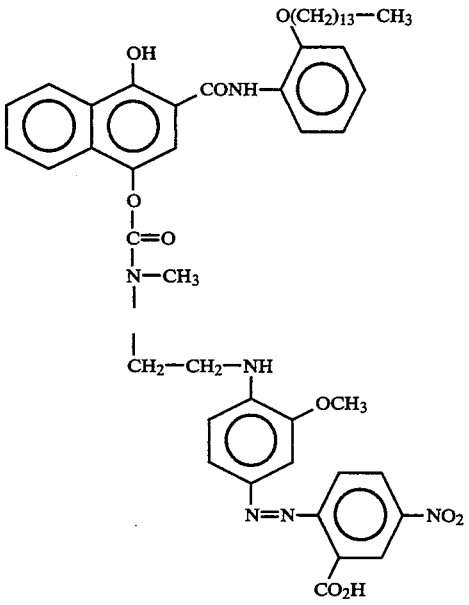
-continued
12.
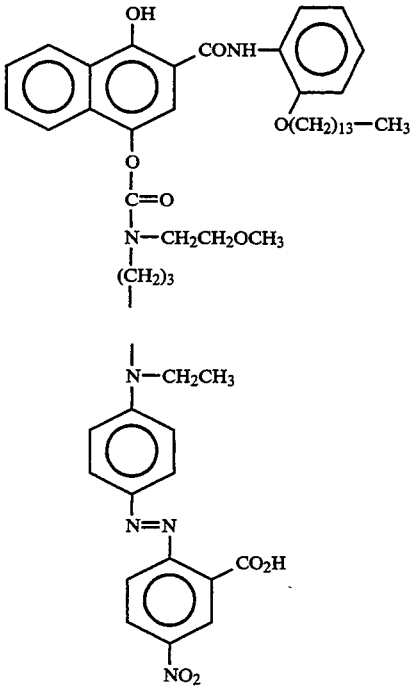
13.
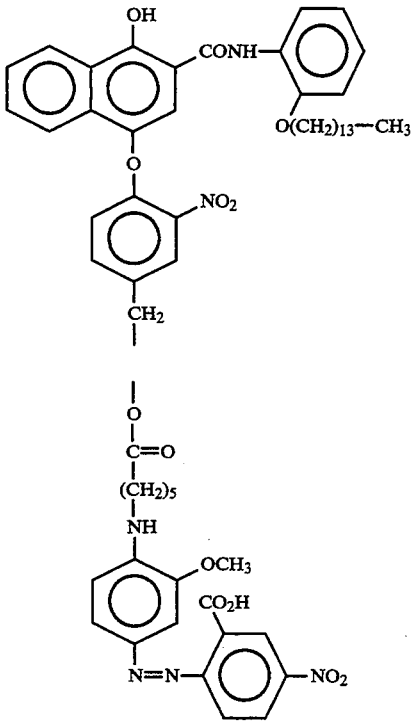
14.
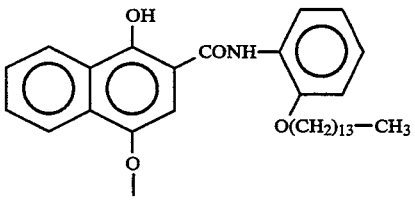

-continued
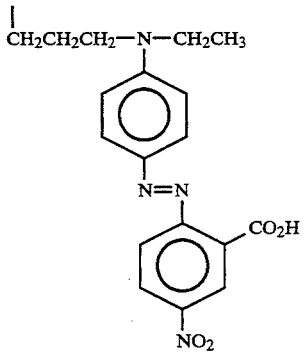
15.
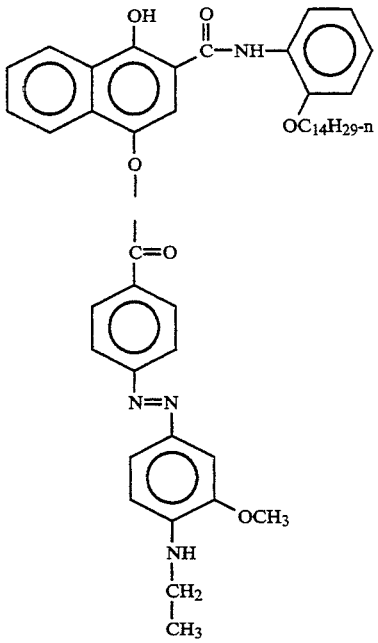
16.
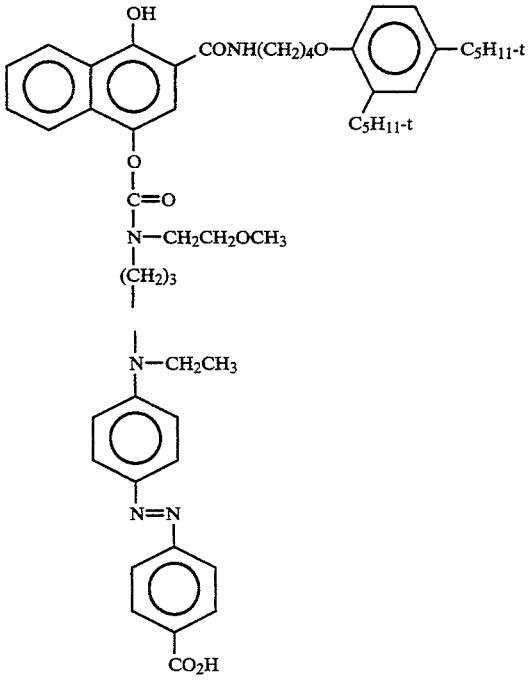
-continued
17.
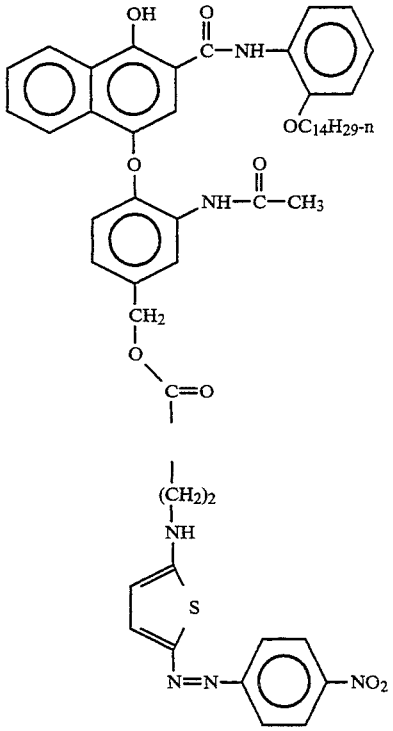
18.
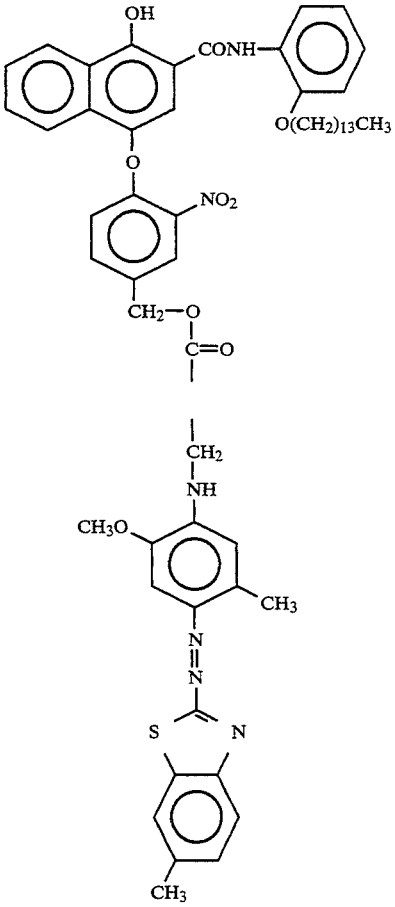

-continued
19.
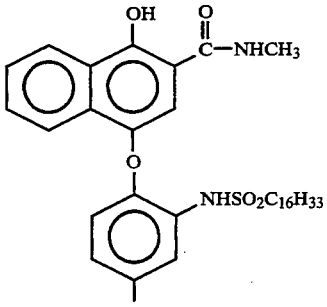
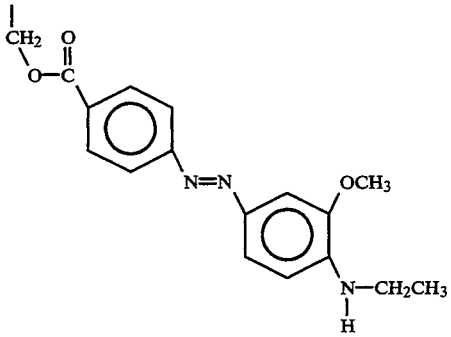
20.
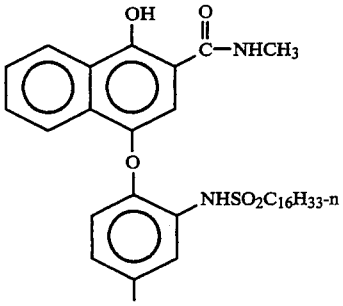
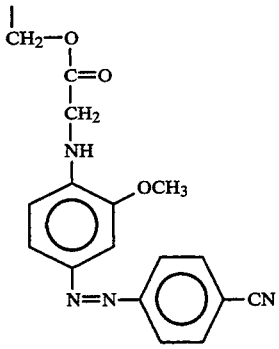
21.
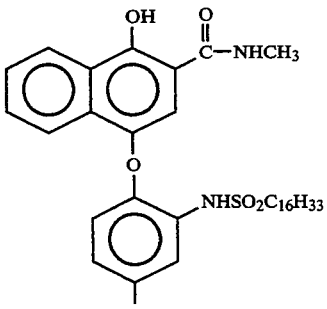
-continued
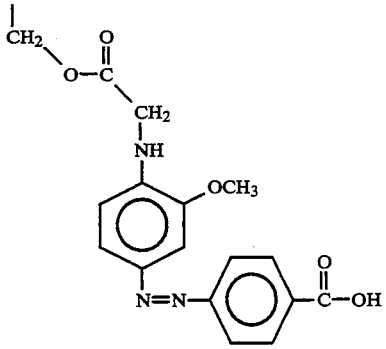
22.
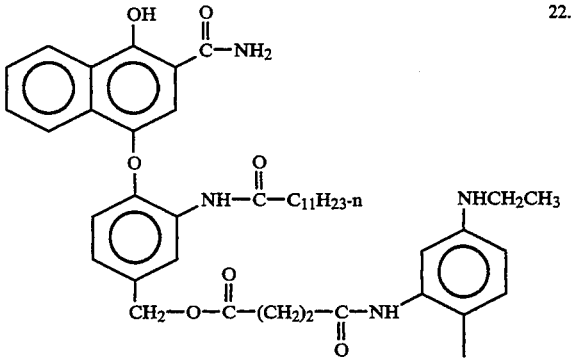
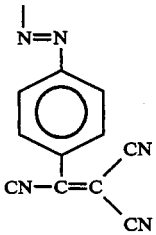
23.
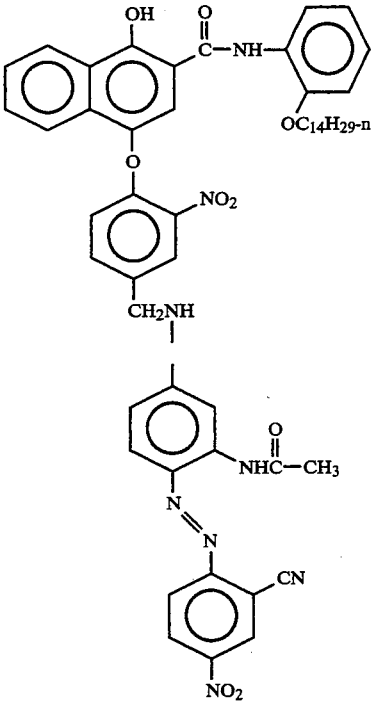

It has been found that the unblocked yellow-colored masking couplers of the present invention, such as example 19 set forth previously, when incorporated in a photographic emulsion, produce an intrinsic blue speed loss due to absorption of blue light relative to colorless image couplers. To solve this problem, it has been found that blocking groups can be utilized with these yellow azoaniline dyes containing masking couplers which shift the hue of the couplers from about 440nm for the unblocked couplers, to about 340nm when blocked. This hue shift results in a reduction in the blue light absorption of the couplers and thus produces a blue speed increase relative to the unshifted coupler. Upon standard processing, such as C41 processing or any hydroxylamine containing process, the blocking group is removed and the hue is shifted back to 440nm to produce an integral color mask.

Accordingly, in a particularly preferred embodiment of the present invention, the auxochromic nitrogen of the dye is acylated with a blocking group which is labile in the presence of hydroxylamine in the developing solution. These blocked masking couplers have low blue density during exposure and high blue density which is required for masking, after processing, resulting in a net blue speed gain relative to unshifted masking couplers. The resulting coupler has the same generic structure of formula B where one of the R groups is a blocking group attached to the auxochromic nitrogen group via a carbonyl linkage.

Examples of blocking groups which can be employed in association with the present masking coupler can be found in UK Patent Application 2,105,482, however, examples of particularly effective blocking groups for use with the present masking coupler are described in U.S. Pat. No. 5,019,492.

Particularly preferred blocking groups include:

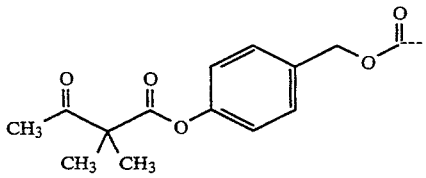

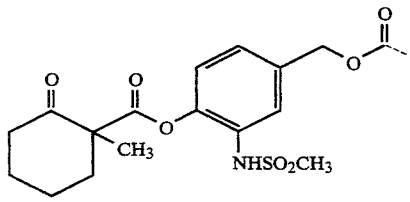

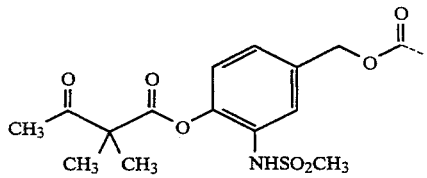

Any of the previously mentioned COUP moieties, can be used as the COUP in the blocked masking coupler. It is preferred that the COUP is other than a magenta coupler, particularly other than a pyrazoletriazole magenta coupler of the formula:

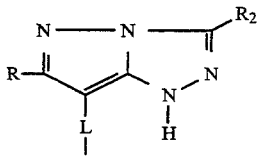

wherein R is $CH_3$ or t-butyl and $R_2$ is a ballast group.

It is especially prefered to use a universal or naphtholic coupler. These couplers have the advantage of being useful in any layer where masking is desired as it does not contribute to negative density, that is it does not produce an image dye. A "universal" coupler is a material which can react with oxidized color developer to produce a colorless product or a material which reacts with oxidized color developer to produce a colored compound which is soluble in developer solution and which is washed out of the film during photographic processing. "Universal" couplers may also release photographically useful groups upon reaction with oxidized color developer.

Preferred universal coupler moieties have the generic structure

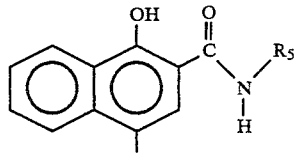

where $R_5$ represents a hydrogen atom, or an alkyl or aryl or heterocyclic group. Preferred $R_5$ groups include H, $CH_3$, $—CH_2CH_2CO_2H$, $—CH_2CH_2—CO_2CH_2CH_3$, $—CH_2—CO_2H$, $—CH_2CO_2CH_2CH_3$, $—CH_2CO_2CH_3$, $—CH_2CH_2—CO_2CH_3$, $—CH_2—CH_2—OCH_3$.

Examples of preferred coupler moieties are disclosed in U.S. Pat. No. 4,482,629.

Any of the previously described linking groups can be used with the blocked masking couplers, however the linking group is preferably a ballasted quinone methide timing group. The preferred blocking groups are disclosed in U.S. Pat. No. 5,019,492, discussed previously.

Examples of these blocked universal couplers include the following:

(24)
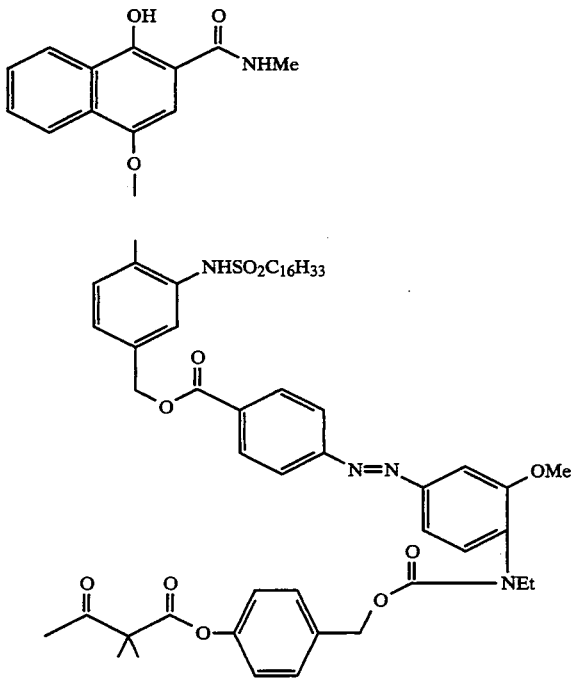
(25)
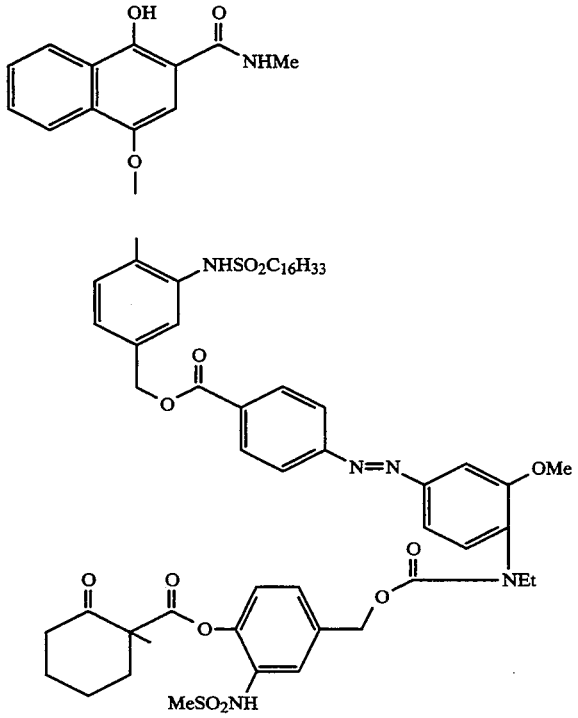
(26)
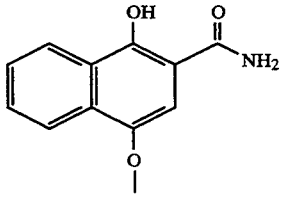

-continued
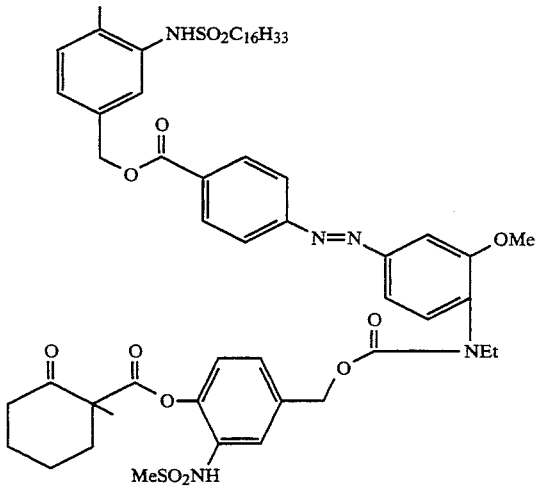
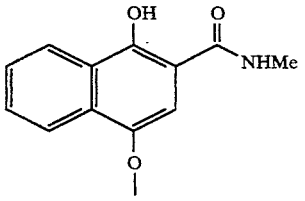
(27)
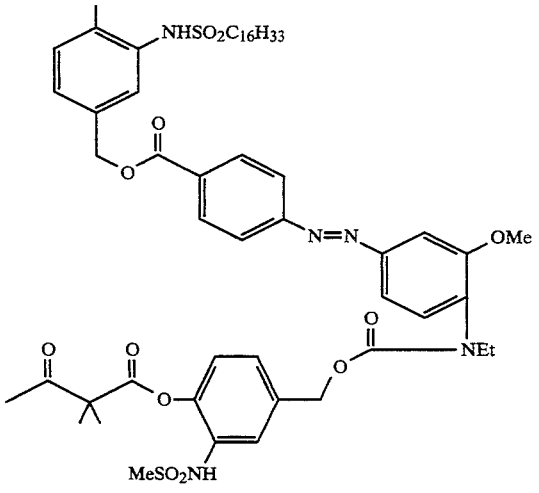
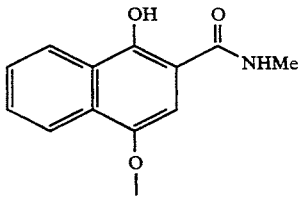
(28)

-continued
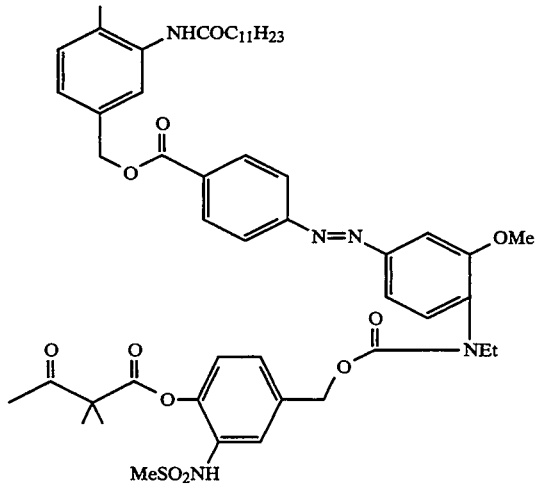
(29)
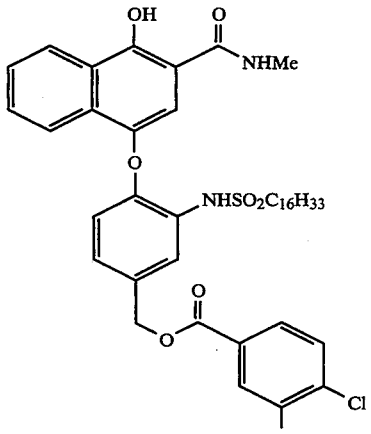
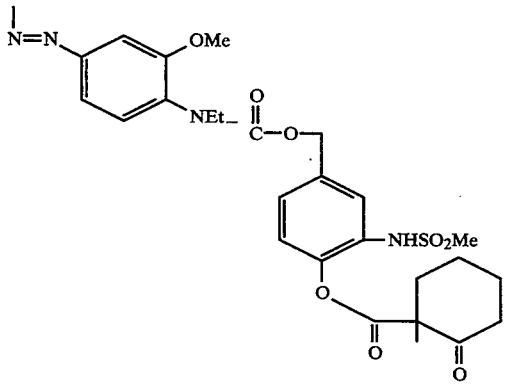

-continued
(30)
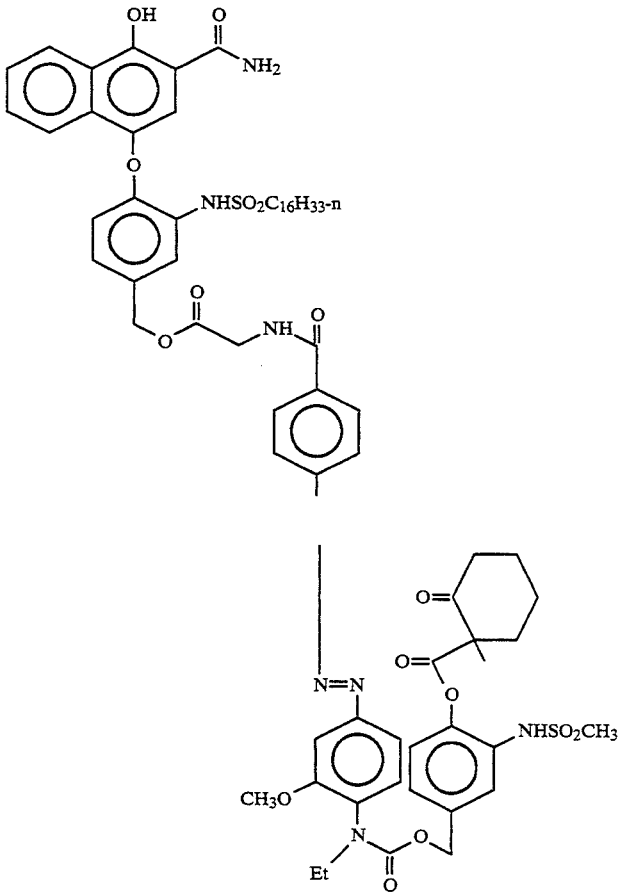
(31)
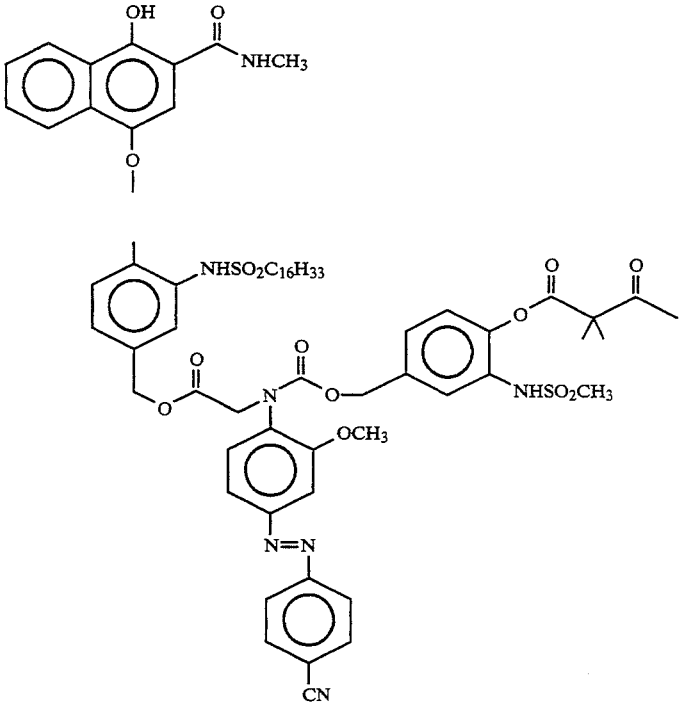

-continued
(32)
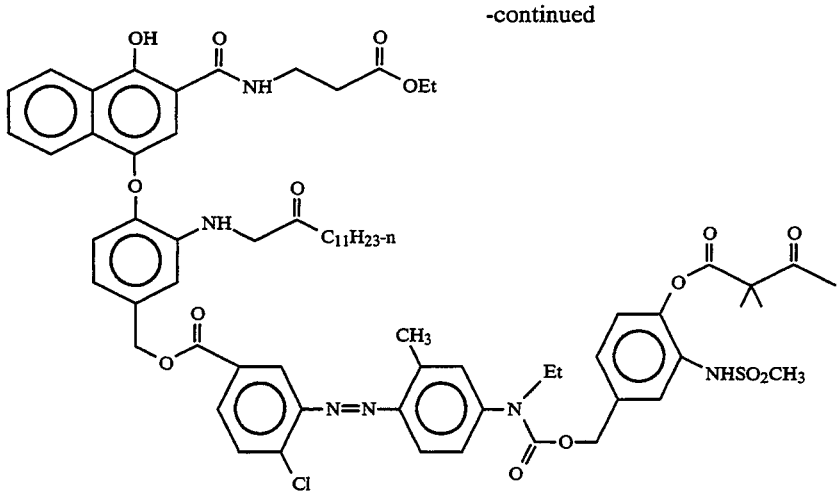
(33)
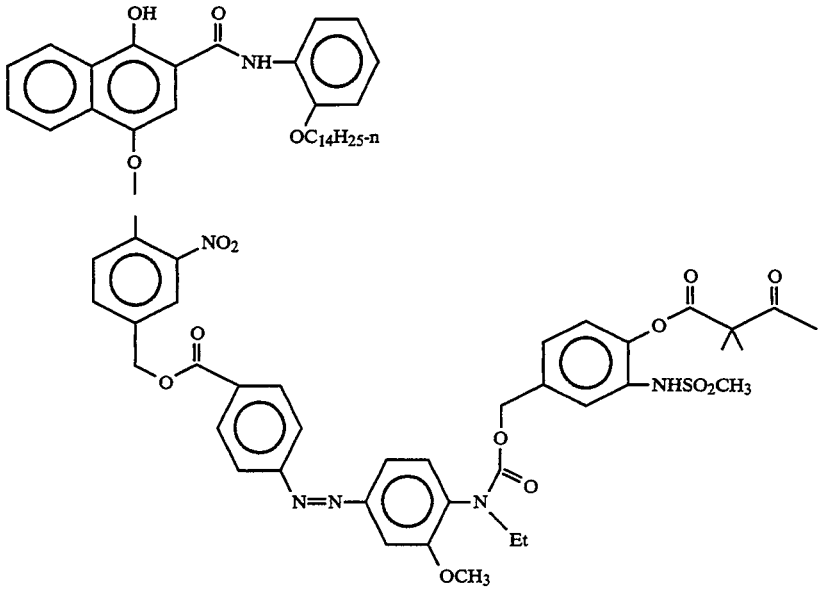
(34)
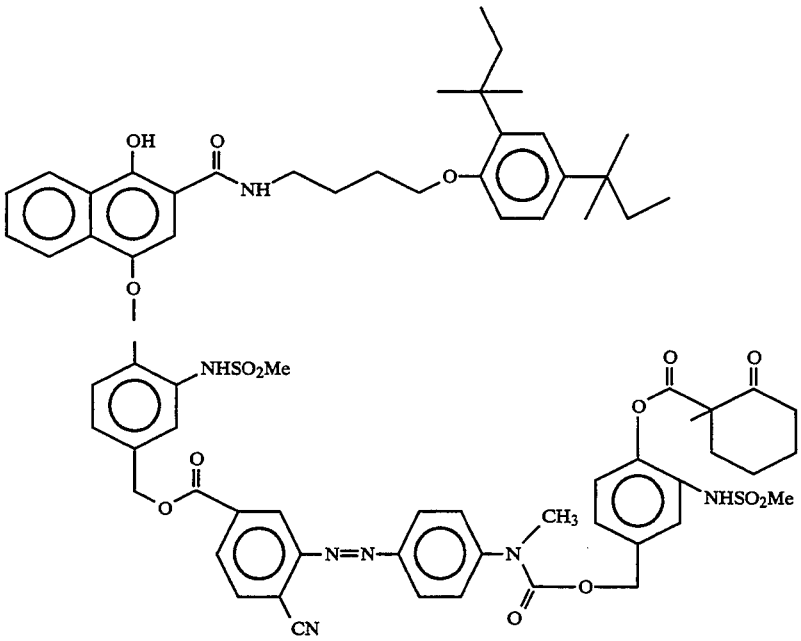

-continued
(35)
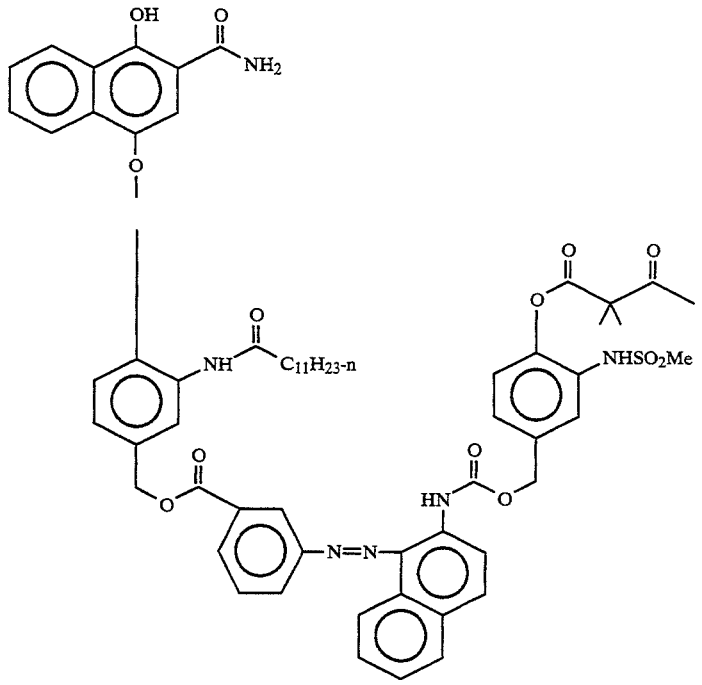
(36)
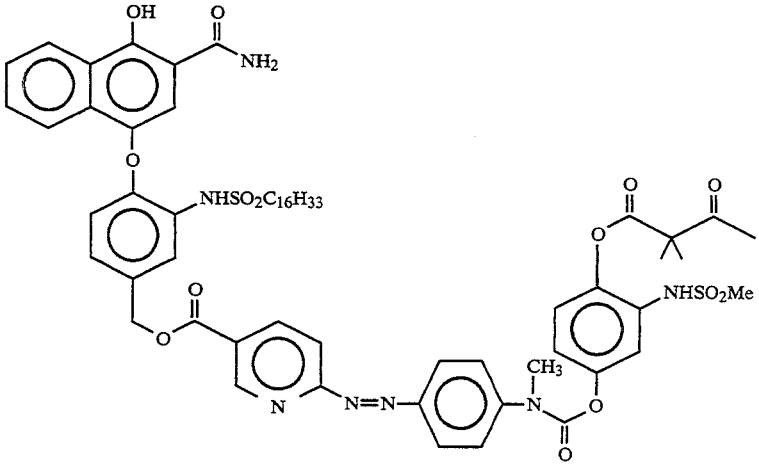
(37)
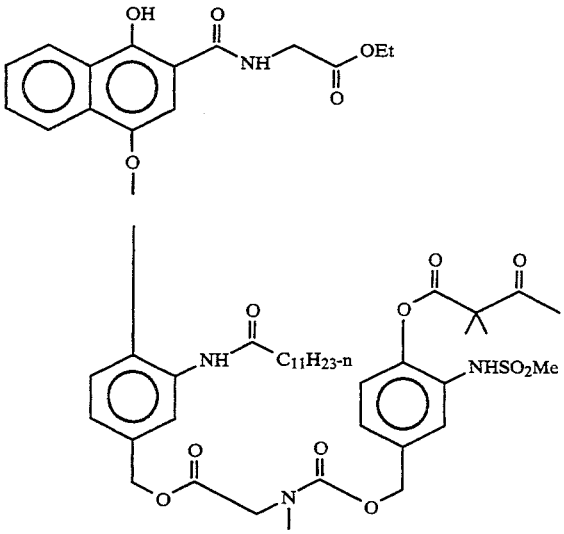

-continued
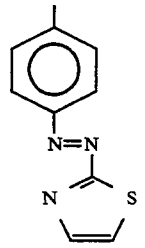
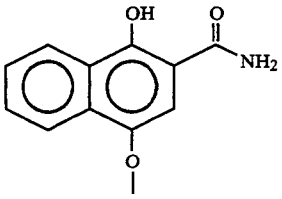
(38)
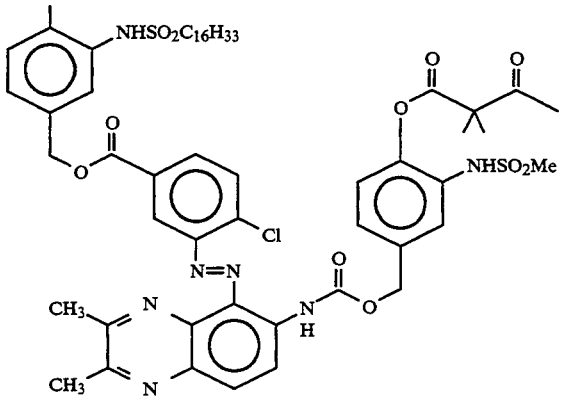
(39)
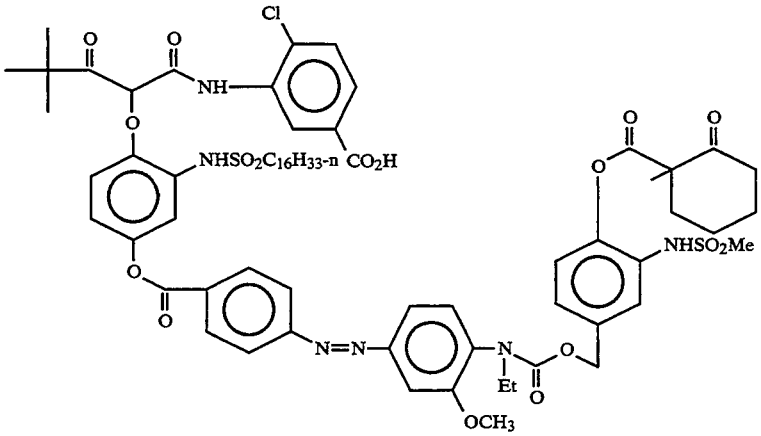

-continued
(40)
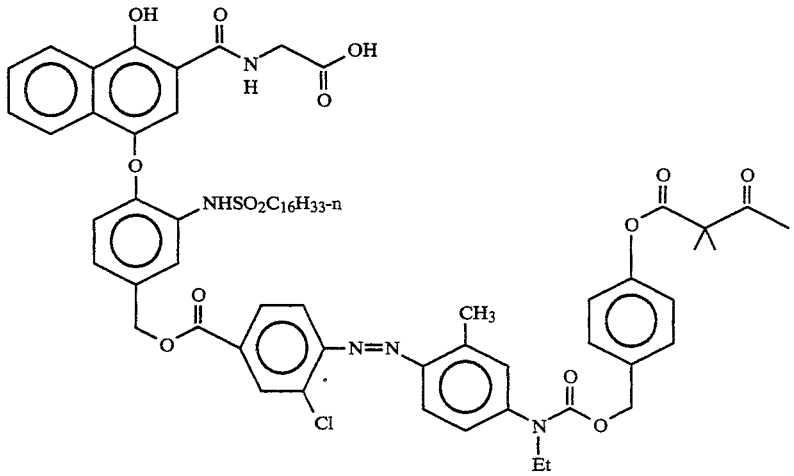
(41)
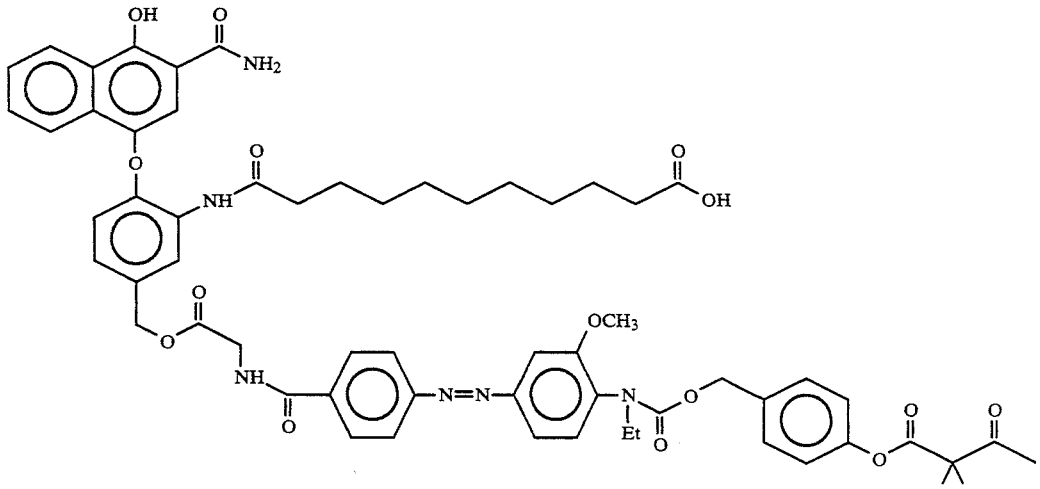
(42)
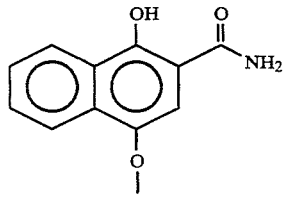
(42)
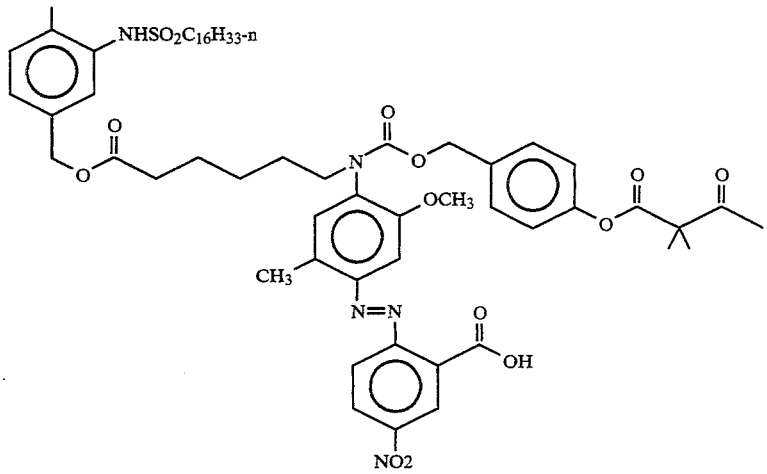

-continued
(34)
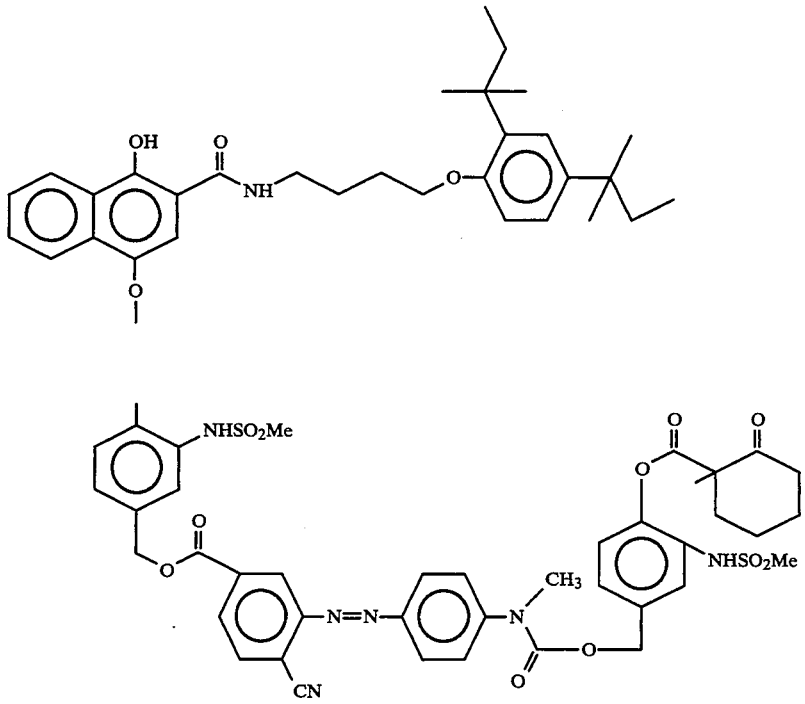
(35)
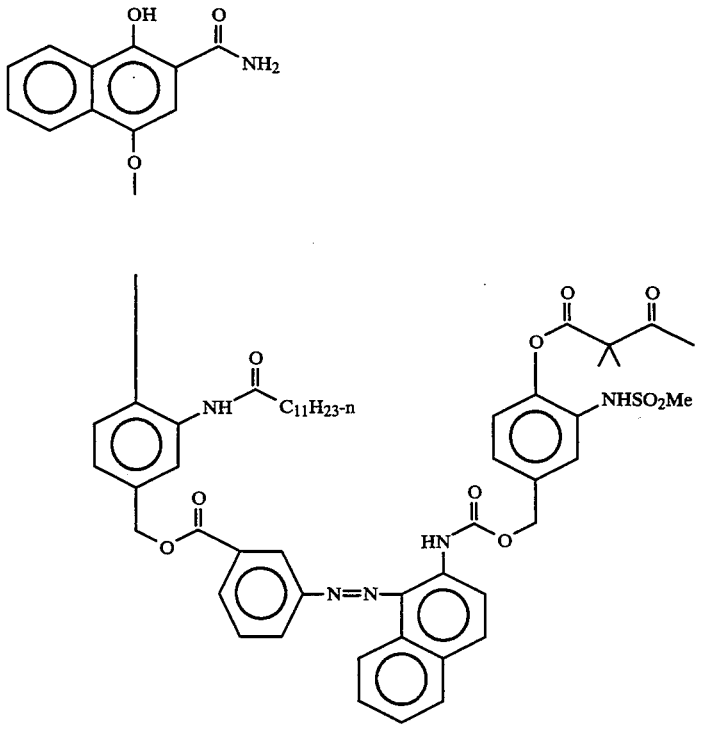

-continued
(36)
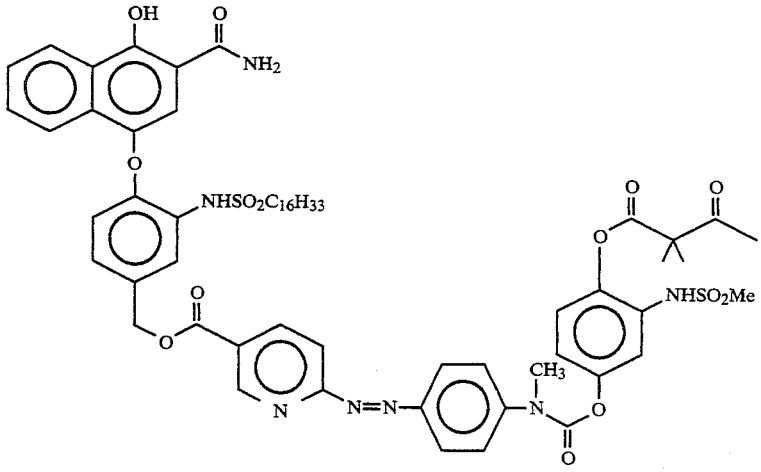
(37)
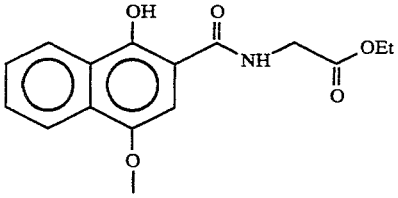
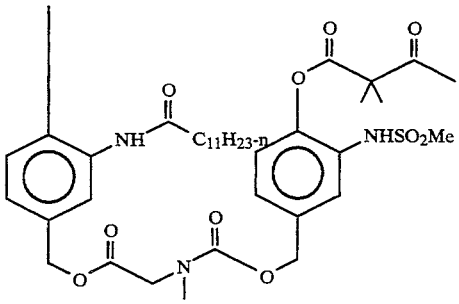
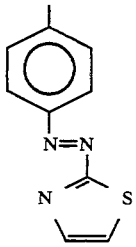
(38)
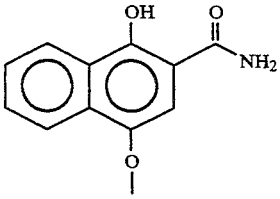

-continued
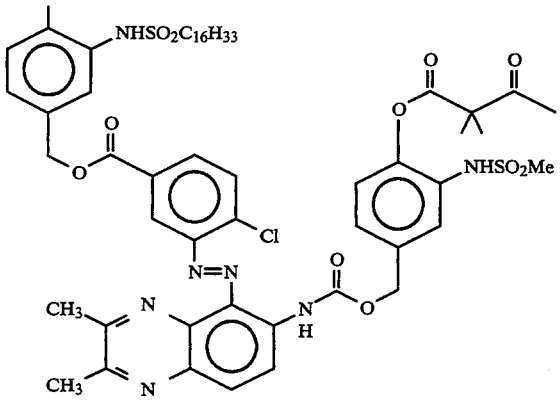
(39)
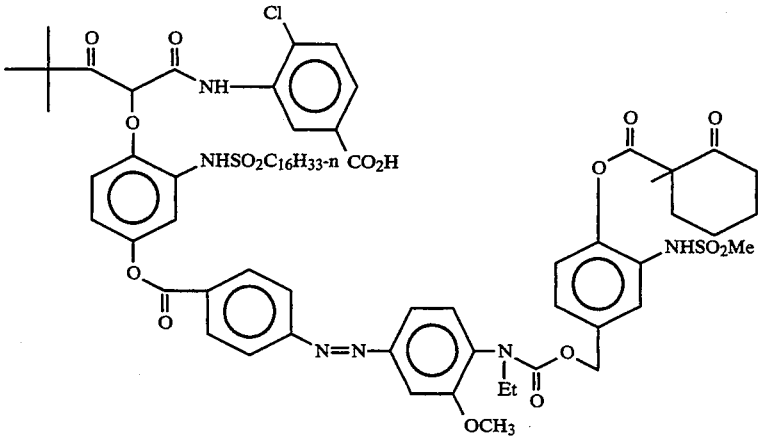
(40)
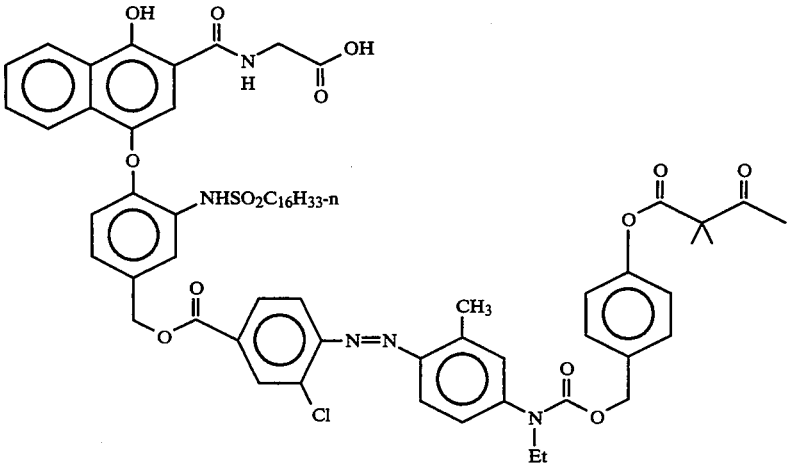

-continued

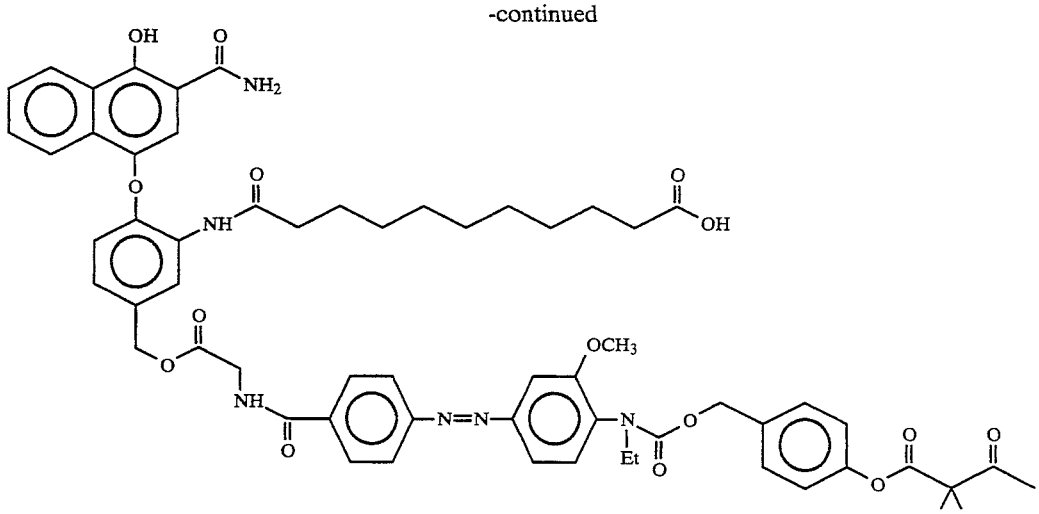

(41)

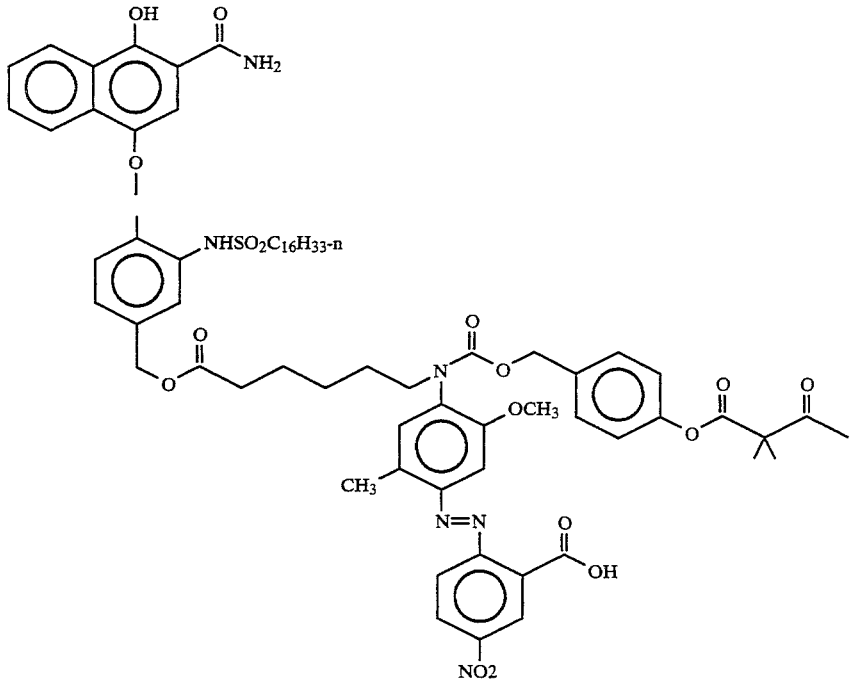

(42)

(42)

Couplers 24–30 are particularly preferred.

The synthesis of coupler 27 will now be described with reference to the reaction scheme shown below.

Sodium borohydride (1.23 g, 33 mmol) was added over 30 min to a stirring solution of Compound (a) (11.9 g, 33 12 mmol) in a mixture of 75 mL of THF, 25 mL of methanol and mL of water at ambient temperature. The solution was then filtered and concentrated in vacuo. The residue was dissolved in ethyl acetate and washed with 2N HCl and dried. Removal of solvent provided 10.64 g, (89% yield) of Compound (b) as a tan solid.

Compound (b) (9.55 g, 26 mmol) was hydrogenated (40 psi $H_2$/Pd/C, 190 mL of methanol) for 1.5 hours. The solution was filtered to remove catalyst, the volume of solvent was reduced to 100 mL, and the solution was added to water (400 mL) with vigorous stirring. The resulting tan precipitate was collected and dried to provide 6.95 g (80% yield) of Compound (c) as a tan solid.

1-Chlorosulfonylhexadecane (16.4 g, 50 mmol) was added to a solution of Compound (c) (15.5 g, 46 mmol) in pyridine (140 mL) at ambient temperature. After 35 min the solvent volume was reduced in vacuo to ca. 25 mL and the residue was dissolved in ethyl acetate and washed with 2N HCl and dried. Removal of solvent and chromotographic purification provided 20.94 g (73% yield) of Compound (d) as an off-white solid.

Compound (d) (6.25 g, 10 mmol) was dissolved in glacial acetic acid (60 mL) and heated at 70° C. To this solution was added 31% HBr in acetic acid (8.4 mL). After 10 min a precipitate formed. The solution was cooled to room temperature and poured in to water (600 mL) with stirring. The resulting white solid was collected and dried to provide 6.6 g (96% yield) of Compound (e) .

Compound (e) (1.4 g, 2 mmol) was added to a solution of shifted dye (o) (see scheme 2 for the preparation of (o)) (1.3 g, 2 mmol) and cesium carbonate (0.325 g, 1 mmol) in 1,3-dimethyl-3,4,5,6-tetrahydro-2-(1H)-pyrimidinone (DMPU) (8 mL) at ambient temperature. After 3.5 hours the solution was diluted with ethyl acetate, washed with water, and dried. Solvent was removed and the residue was chromatographically purified to provide 1.3 g (52% yield) of Coupler 27 as an orange solid (UV max at 340 nm).

Compound (o) was synthesized by the following sequence:

A solution of o- anisidine (f) (370 g, 3 moles) and ethyl bromide (500 g, 4.59 moles) in iso-propyl alcohol (1 L) was heated at reflux for 16 hours. The solution was then cooled in ice and the resulting white precipitate of Compound (g) was collected and dried to provide 422 g (90% yield) of (g) as white crystals.

Methyl-p-aminobenzoate (h) (15.1 g, 100 mmol) was diazotized by treatment with sodium nitrite (6.90 g, 100 mmol) in 10% aqueous HCl (45 mL) at 0° C. The resulting diazonium solution was added dropwise to a solution of Compound (g) (23.2 g, 100 mmol) in water (100 mL) at 0° C. over 30 min. After 1 hour the resulting red solution was treated with sodium acetate (10 g) and an orange precipitate formed which was collected and dried to provide 30 g (97% yield) of Compound (i) as an orange solid.

Azodye (i) (50 g, 160 mmol) was dissolved in methanol and THF (200 mL each) and treated with 2N NaOH solution (250 mL) at 45° C. for 20 min. The solution was then cooled to 0° C. and 250 mL of 2N HCl was added dropwise. The resulting orange precipitate was collected and dried to provide 42.9 g (90% yield) of Compound (j) .

Compound (j) (29.9 g, 100 mmol) was added to a solution of diisopropylethylamine (18.9 mL, 110 mmol) in dichloromethane (250 mL) and was cooled to −20° C. A solution of chloromethylethylether (9.6 mL, 102 mmol) in dichloromethane (50 mL) was then added dropwise over a 20 min period, after which the solution was allowed to warm to room temperature. The solution was washed with cold 2% aqueous HCl, and saturated NaCl solution and dried. The solvent was removed in vacuo to provide 32.5 g (98% yield) of Compound (k) as an orange solid.

A solution of Compound (k) (21.4 g, 60 mmol) and 2,6-lutidine (9.27 mL, 80 mmol) was treated with a 2.4 M solution of phosgene in toluene (33 mL, 80 mmol) at ambient temperature. After 1 hour, the solution was washed with ice cold 2% aqueous HCl and dried solvent was removed to provide 25 g (99% yield) of the carbamyl chloride (1) as an orange solid.

Carbamoyl chloride (1) (25 g, 60 mmol) and benzylic alcohol (m) (19.7 g, 60 mmol) were dissolved in dichloromethane (50 mL) and 4-dimethylaminopyridine (DMAP) (11.5 g, 94 mmol) was added followed by (1,8-diazabicyclo[5.4.0]undec-7-ene (DBU) (19 mL, 126 mmol). The resulting solution was stirred at room temperature for 35 min and then diluted with dichloromethane, washed with cold 2% aqueous HCl and dried. Removal of solvent and chromatographic purification provided 21.36 g (50% yield) of Compound (n) as an orange solid.

Compound (n) (21.36 g, 30 mmol) was dissolved in methanol (180 mL) and THF (20 mL) and treated with trifluoroacetic acid (60 mL) at 50° C. for 3 hours. The solution was then poured into water (600 mL) and the orange precipitate of Compound (o) (18.3 g, 93% yield) was collected and dried.

Reaction Scheme

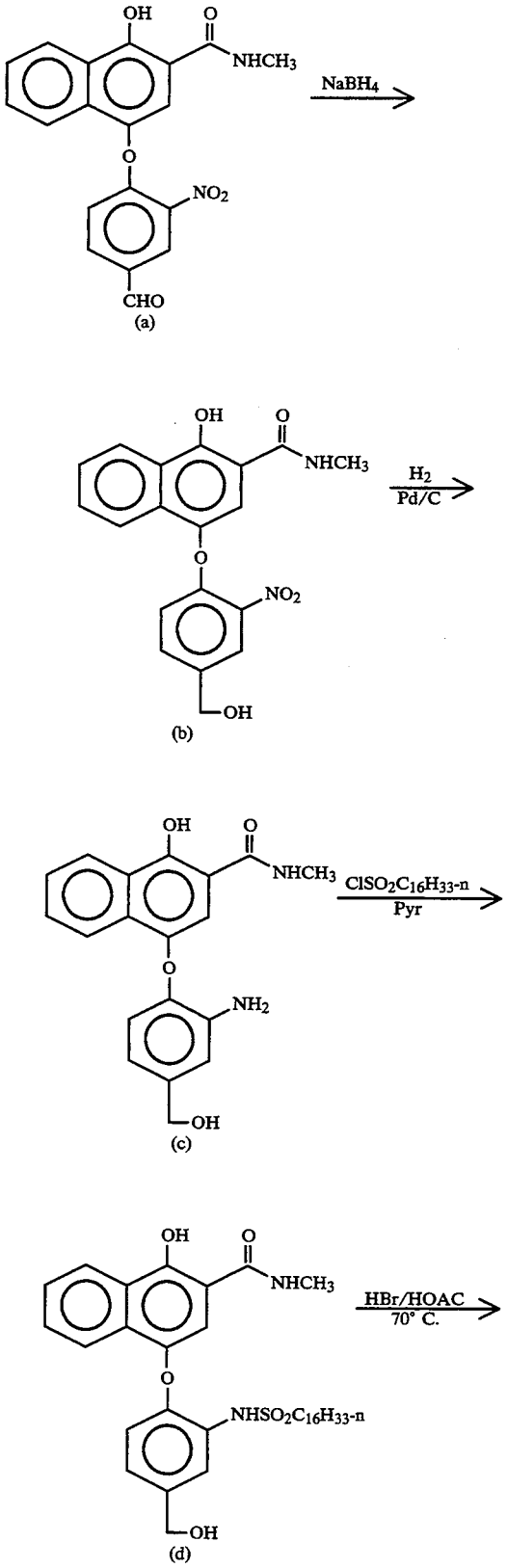

-continued
Reaction Scheme
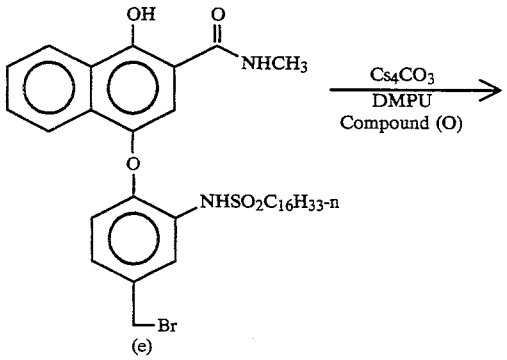
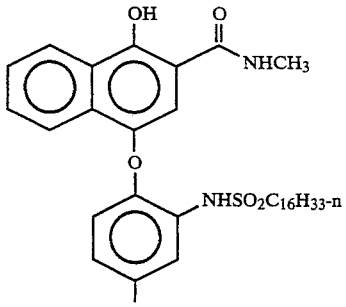
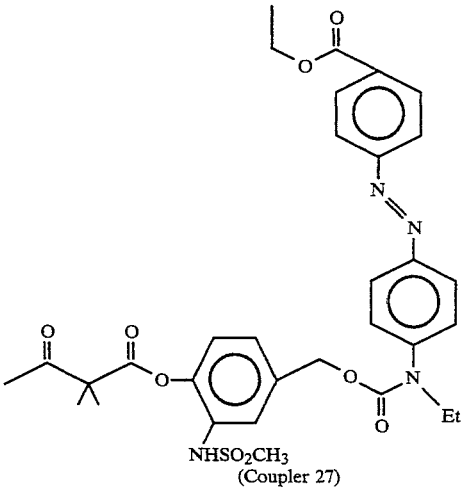
Scheme 2: Preparation of Compound (o)
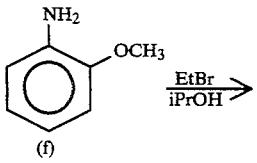
-continued
Scheme 2: Preparation of Compound (o)
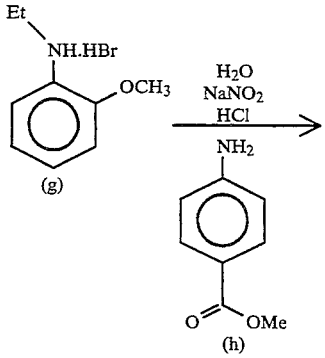
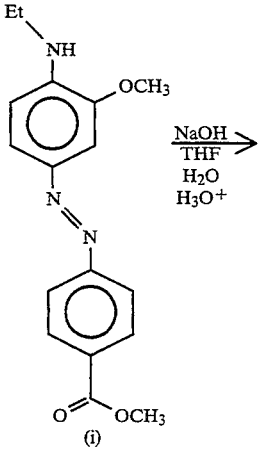
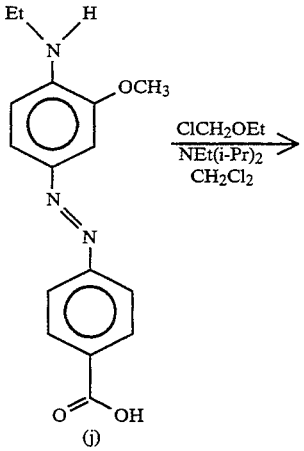

-continued

Scheme 2: Preparation of Compound (o)

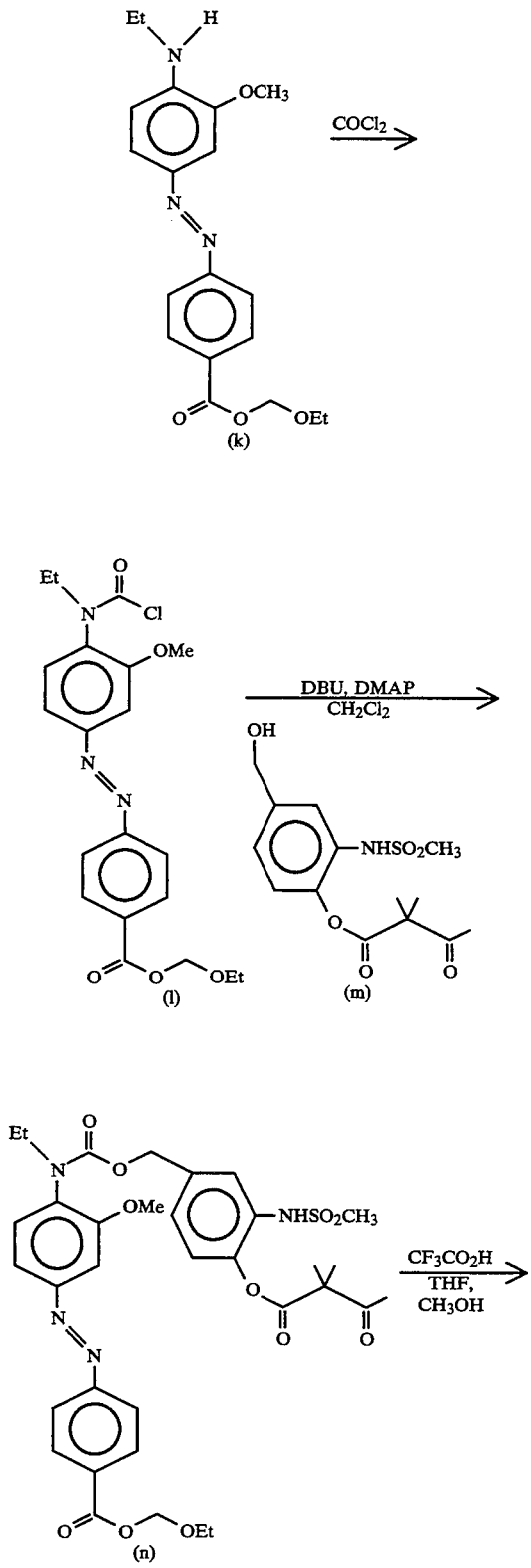

-continued

Scheme 2: Preparation of Compound (o)

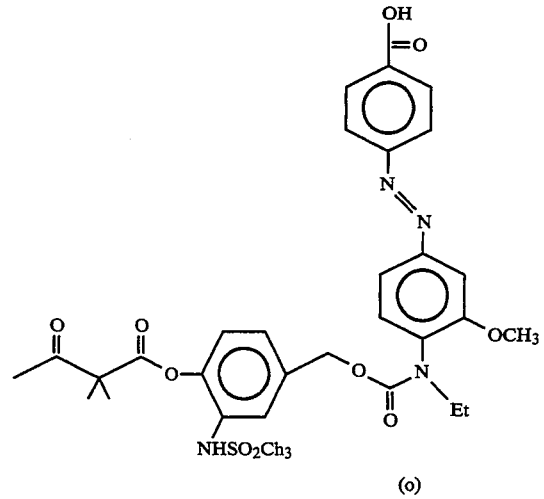

Compound a is made via a route analogous to the route on page 23.

The foregoing masking couplers both blocked and unblocked can be incorporated into single layer silver halide photographic elements by coating a cellulose acetate-butyrate film support with a photosensitive layer containing a silver bromoiodide emulsion at 1.08 g/m$^2$, gelatin at 3.42 g/m$^2$, an image coupler dispersed in half its weight of dibutyl phthalate and/or one of the masking couplers dispersed in its own weight of diethyl lauramide at the indicated laydown. The photosensitive layer was overcoated with a layer containing gelatin at 5.40 g/m$^2$ and bis-vinylsulfonyl methyl ether hardener at 1.75 weight percent based on total gel.

A masking coupler having a structure according to Example 13 was exposed imagewise through a stepped density test object and processed at 37.8 ° C. employing the following color developing solution, then stopped with a low pH bath, bleached, fixed, washed, and dried to produce stepped colored images.

Color Developing Solution:
800.0 ml water;
34.30 g potassium carbonate, anhydrous;
2.32 g potassium bicarbonate;
0.38 g sodium sulfite, anhydrous;
2.78 g sodium metabisulfite;
1.20 mg potassium iodide;
1.31 g sodium bromide;
8.43 g diethylenetriaminepentaacetic acid pentasodium salt (40% solution);
2.41 g hydroxylamine sulfate (HAS);
4.52 g KODAK Color Developing Agent CD-4; and
1.00 L of water to make, 10.0 pH.

For comparative purposes, photographic elements having conventionalmagenta-colored cyan masking coupler compound A disclosed on page 3 was also exposed imagewise and processed as above.

TABLE 1

| Masking Coupler | Magenta Colored Masking Couplers Coated by Themselves: Level g/m$^2$ (mol/m$^2$) | Green $E_{min}$ | Green $E_{max}$ | Red $E_{min}$ | Red $E_{max}$ |
|---|---|---|---|---|---|
| Conventional Compound A | 1.08 (0.011) | 0.170 | 0.060 | 0.154 | 0.273 |
| Example 13 | 1.14 | 0.267 | 0.050 | 0.114 | 0.259 |

TABLE 1-continued

| Masking Coupler | Magenta Colored Masking Couplers Coated by Themselves: Level g/m² (mol/m²) | Green $E_{min}$ | Green $E_{max}$ | Red $E_{min}$ | Red $E_{max}$ |
|---|---|---|---|---|---|
| | (0.011) | | | | |

$E_{min}$ = Density (in the appropriate color) at minimum exposure to light
$E_{max}$ = Density (in the appropriate color) at minimum exposure to light
Level = lay down

TABLE 2

| Cyan Image Coupler (Level) | Magenta Colored Masking Couplers Coated with Cyan Image Couplers: Masking Coupler (Level) | Green $E_{min}$ | Green $E_{max}$ | Red $E_{min}$ | Red $E_{max}$ |
|---|---|---|---|---|---|
| Compound X (6.48) | — | 0.101 | 0.401 | 0.067 | 2.449 |
| | Conventional Compound A (1.08) | 0.340 | 0.450 | 0.075 | 2.644 |
| | Example 13 (1.14) | 0.410 | 0.449 | 0.088 | 2.626 |

Level = lay down of masking coupler in g/m²

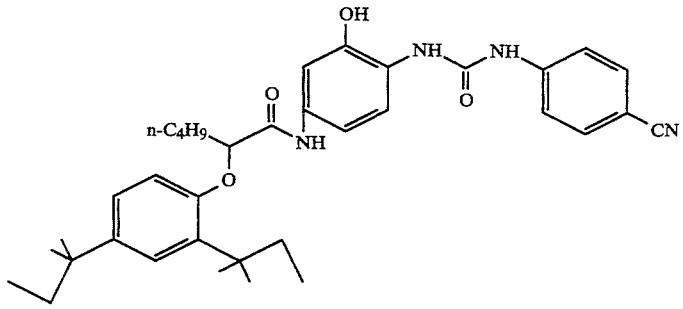

COMPOUND X

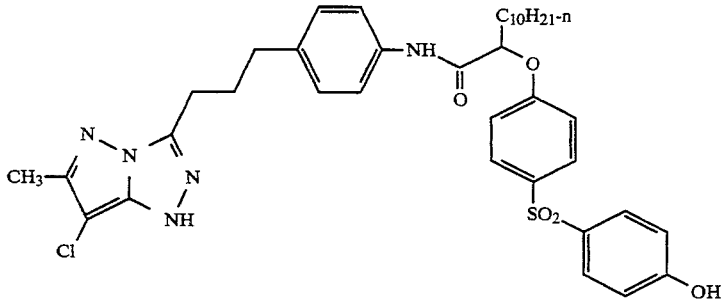

Y

Densitometry in the appropriate color region of these images provided a measure of density at minimum and maximum exposure as shown in Tables 1 and 2.

The data in Table 1 demonstrates that Example 13 behaves as a magenta-colored cyan masking coupler. For example, formation of red density indicates coupling of the cyan parent with the oxidized developing agent. Green density is high at minimum exposure, i.e., no coupling occurs so masking dye remains in the film, and low at maximum exposure, i.e., coupling occurs thus the magenta dye releases and is washed out or removed from the film.

The data in Table 2 demonstrates that Example 13 results in a superior masking effect in comparison to the conventional masking couplers. For example, the green density values at minimum and maximum exposure are significantly closer for Example 13 than for conventional compound A. Thus, there is less of an overall green scale, i.e., $E_{min}=E_{max}$, for Example 13 than for conventional compound A.

FIG. 1 shows electronic spectra of a blocked magenta-colored coupler (solid line) and the same coupler without the blocking group (dotted line), which demonstrates the unexpectedly large shift in the maximum absorption of a magenta azoaniline dye upon being blocked.

Figure 2:
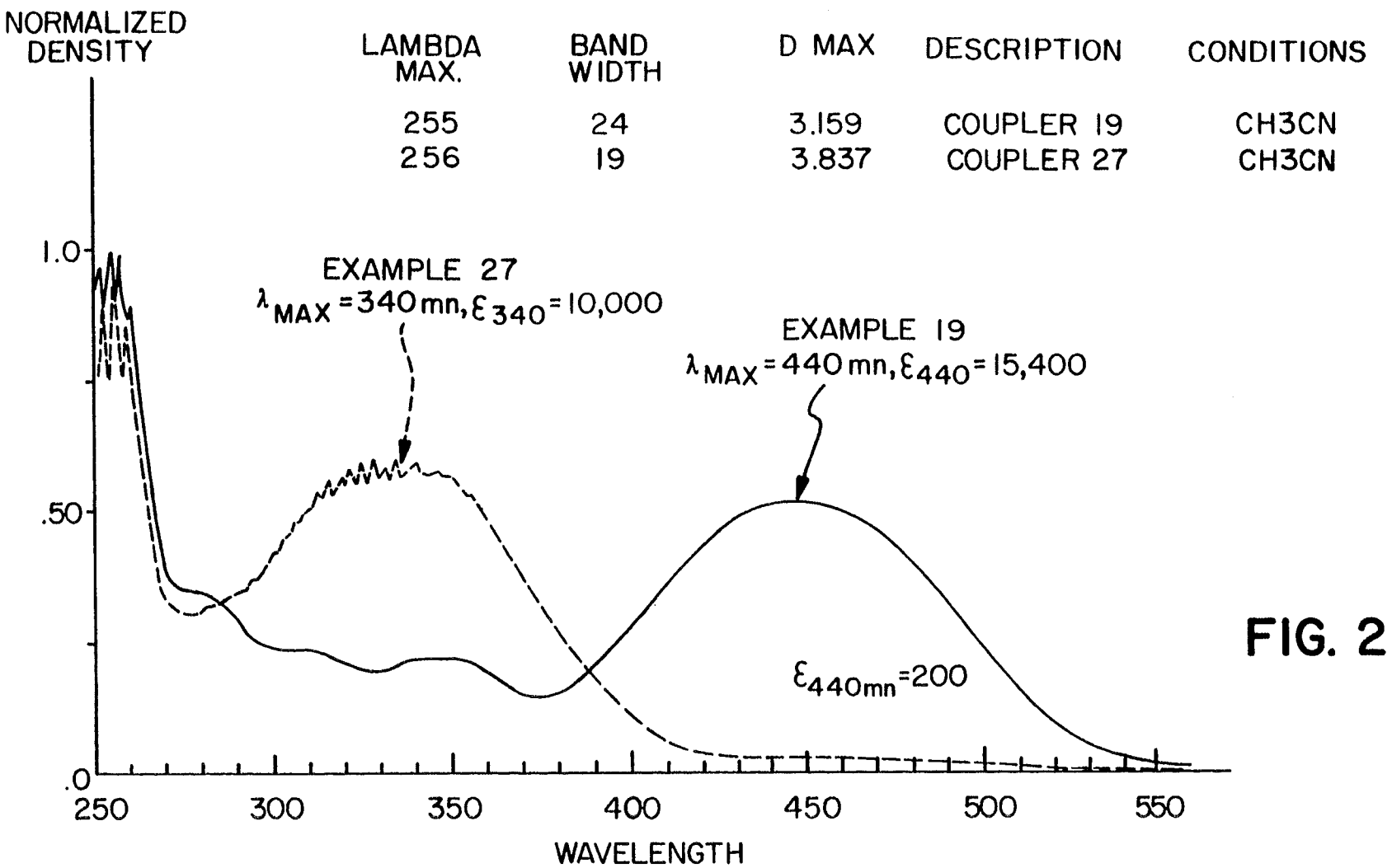
FIG. 2 is a graph representing the hue shifting upon unblocking of a yellow-colored masking coupler according to the present invention.

FIG. 2 shows electronic spectra of example 27 (blocked dye) and example 19 (unblocked dye), which demonstrates the shift of a yellow colored azoaniline dye upon being blocked.

Both masking couplers were blocked with groups according to U.S. Pat. No. 5,019,492. In contrast, it is very difficult to shift conventional compound A in a practical, easy-to-reproduce manner.

Table 3 shows data for white light exposure of coatings containing shifted masking couplers. The table demonstrates improved speed relative to the unblocked example 19. Hence, it is seen that blocking the couplers according to the invention provides a further improvement in the blue speed of a photographic element.

TABLE 3

| Masking Coupler (g/m²) | $D_{ave.}$ @ $E_{min}$ | Chart Rel. Units SPD (Above $D_{min}$) .15 | .30 | (g/m²) Image Coupler Laydowns |
|---|---|---|---|---|
| — | 0.055 | 287 | 267 | 0.647 Compound X |
| 0.209 Example 19 | 0.539 | 257 | 239 | 0.647 Compound X |
| 0.273 Example 27 | 0.550 | 277 | 258 | 0.647 Compound X |
| 0.279 Example 25 | 0.492 | 277 | 258 | 0.647 Compound X |
| 0.276 Example 26 | 0.552 | 270 | 251 | 0.647 Compound X |
| 0.250 Example 28 | 0.569 | 271 | 253 | 0.647 Compound X |
| 0.280 Example 29 | 0.510 | 271 | 252 | 0.647 Compound X |
| None | 0.062 | 278 | 259 | 0.621 Compound Y |
| 0.209 Example 19 | 0.533 | 244 | 226 | 0.621 Compound Y |
| 0.273 Example 27 | 0.543 | 265 | 247 | 0.621 Compound Y |
| 0.276 Example 26 | 0.557 | 256 | 240 | 0.621 Compound Y |

Figure 3:
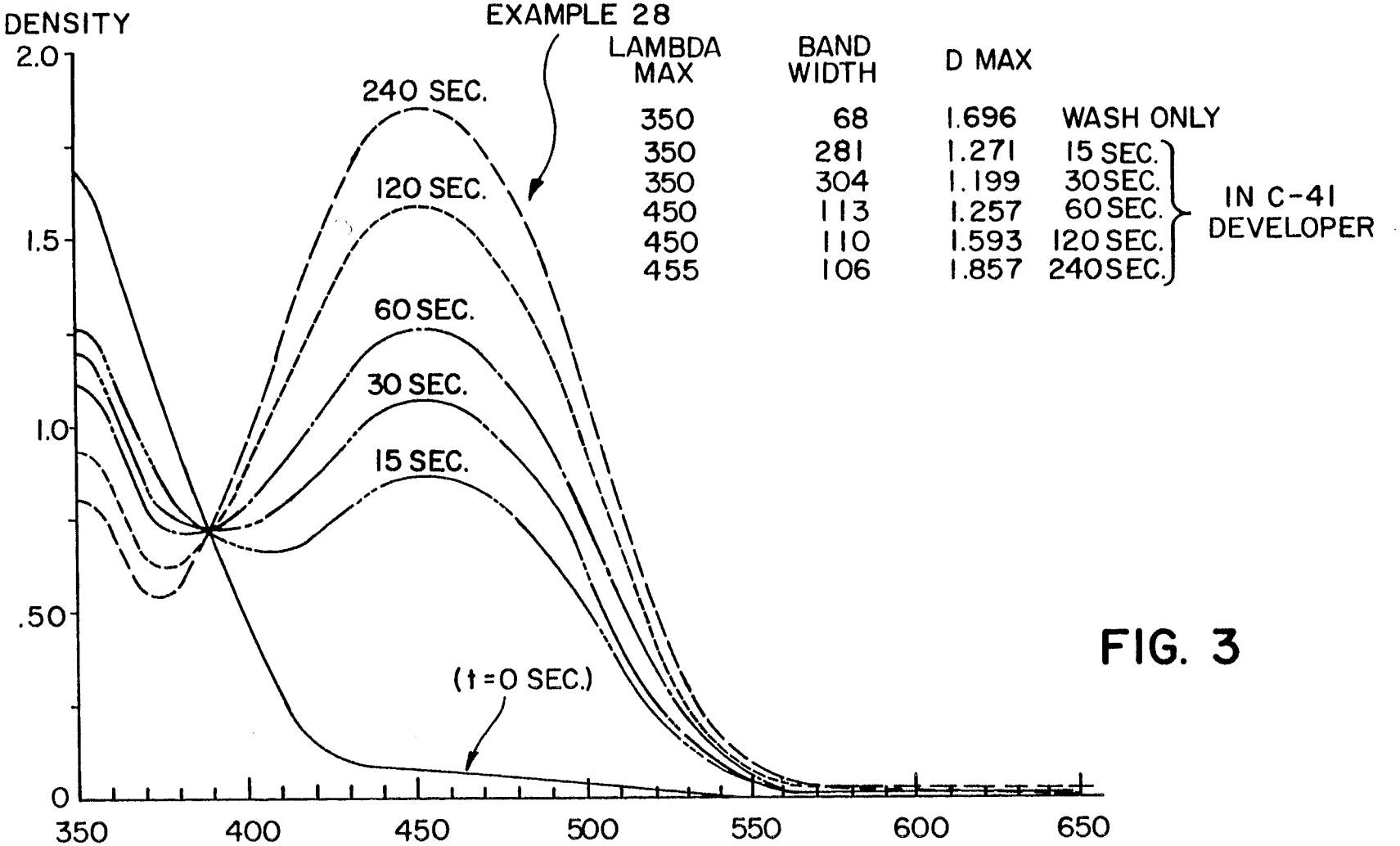
FIG. 3 is a graph showing increased blue density during the development of a blocked masking coupler according to the invention.

FIG. 3 shows electronic spectra of Example 25 exposed to colorphotographic developer. The spectum marked t=0 shows the electronic spectrum of Example 28 before being exposed to color developer solution. Subsequent spectra at 15 seconds, 30 seconds, 60 seconds, 120 seconds and 240 seconds show that upon exposure to color developer the blocked dye, which was substantially colorless became colored (yellow—having its major absorbance at 450 nm) during the time frame usually associated with commercial development of color negative films.

The invention has been described in detail with particular reference to certain preferred embodiments thereof, but it will be understood that variations and modifications can be effected within the spirit and scope of the invention.

Having thus described our invention, what we claim as new and desire to secure by Letters Patent is:

1. A photographic element comprising a support bearing a silver halide photographic emulsion, at least one color-forming coupler and a masking coupler which contains a single azo group, wherein the generic chemical structure of said masking coupler is represented by the formula B

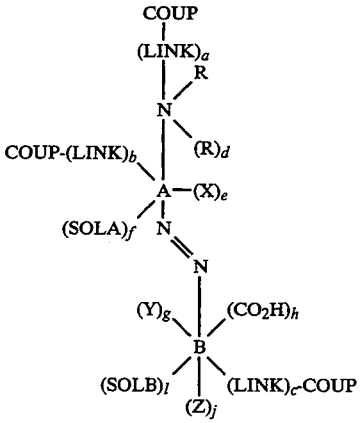

(B)

wherein a is 1 when b and c are 0, b is 1 when a and c are 0, or c is 1 when a and b are 0;

d, e, f, g, h, i, j may be 0 or 1;

A and B are the same or different and are an aromatic or heterocyclic group;

R is a hydrogen atom, a branched or unbranched, saturated or unsaturated hydrocarbon group, a heterocyclic group or an aromatic group, or a non-imagewise removable blocking group, wherein the R groups may be the same or different, with the proviso that at least one of the R groups which is present is a non-image-wise releasable blocking group;

X is an alkyl, hydroxy, alkoxy, alkyl carboxyl, amido, sulfonamido, aromatic or heterocyclic group or a halogen atom;

SOLA is a first solubilizing group;

SOLB is a second solubilizing group; and

Y and Z are the same or different and are selected from the group consisting of a halogen atom, an alkyl group, a hydroxy group, an alkoxy group, a carboxyl group, a cyano group, an amido group, a sulfonamido group, a sulfamoyl group, a sulfonyl group, a nitro group, a carboalkoxy group, a carbamoyl group and an acyl group, wherein LINK is any group releasable or cleavable from COUP by coupling with an oxidized developing agent during photographic processing, and wherein only one COUP is present in the masking coupler and this COUP is bonded to the LINK which is present and the COUP comprises a coupler moiety represented by the formula C:

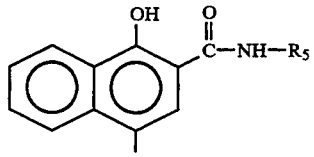

(C)

wherein $R_5$ represents a hydrogen atom, a ballast group, or an alkyl, aryl or heterocyclic group, any of which may be substituted or unsubstituted, and wherein the element is such that the azo dye is released from COUP and washed out of the element during processing.

2. A photographic element as recited in claim 1, wherein A and B are selected from the group consisting of a phenyl, napthyl, thienyl, furyl, pyrrolyl, pyridyl, benzothienyl, indolyl, thiazolyl, benzothiazolyl and an oxazolyl group.

3. A photographic element as recited in claim 2, wherein A and B comprise a phenyl group.

4. A photographic element as recited in claim 1, wherein a and b are 0, c is 1.

5. A photographic element as recited in claim 1, wherein said masking coupler comprises a 4-nitrophenylazoaniline.

6. A photographic element as recited in claim 1, wherein at least one of SOLA and SOLB are present and comprise a carboxyl group.

7. A photographic element as recited in claim 1, wherein one of the R's is a blocking group which is labile in the presence of a hydroxylamine containing developing solution.

8. A photographic element as recited in claim 7, wherein said blocking group:

(a) comprises two electrophilic groups, the least electrophilic of which is bonded directly or through a releasable timing group to the auxochromic nitrogen, (b) is capable of reacting with a dinucleophile; and, (c) the two electrophilic groups are separated from each other by a substituted atom that enables a nucleophilic displacment reaction to occur with release of the DYE upon processing of the photographic element in the presence of a dinucleophilic reagent.

9. A photographic element comprising a masking coupler according to claim 1 and a support bearing at least one blue-sensitive silver halide emulsion layer containing at least one yellow image dye-forming coupler, at least one green-sensitive silver halide emulsion layer containing at least one magenta image dye-forming coupler and at least one red-sensitive silver halide emulsion layer containing at least one cyan image dye-forming coupler.

10. A photographic element as recited in claim 9, wherein said masking coupler is coated with said cyan image dye-forming coupler in said red-sensitive silver halide emulsion layer.

11. A photographic element as recited in claim 9, wherein said masking coupler is coated with said magenta image dye-forming coupler in said green-sensitive photographic silver halide emulsion layer.

12. A photographic element as recited in claim 9, wherein said at least one green sensitive layer is between said at least one red and said at least one blue sensitive layer wherein said red sensitive layer is nearer to the support than said green and blue sensitive layers.

13. A photographic element as claimed in claim 1, wherein the masking coupler is a blocked masking coupler selected from the group consisting of (24)

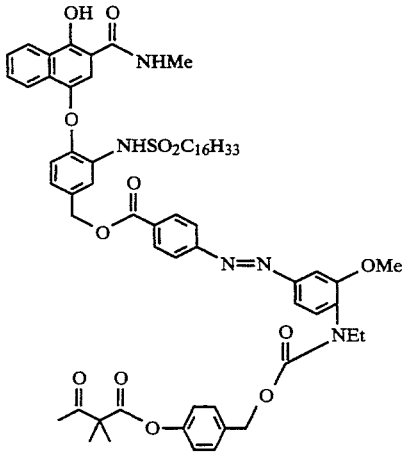

(25)

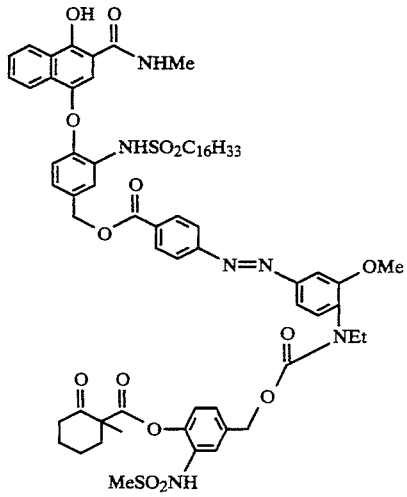

-continued (26)

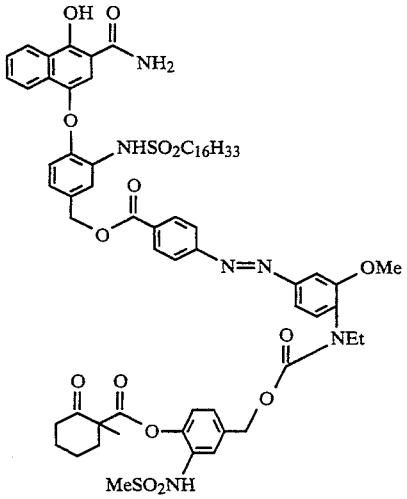

(27)

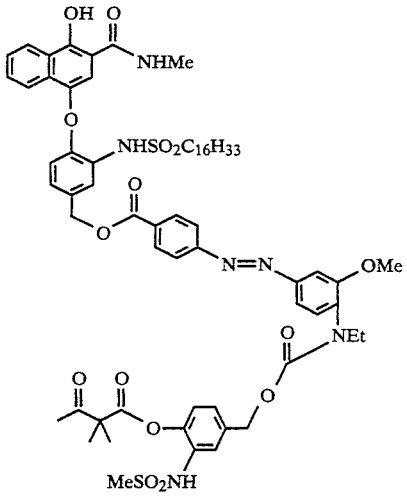

(28)

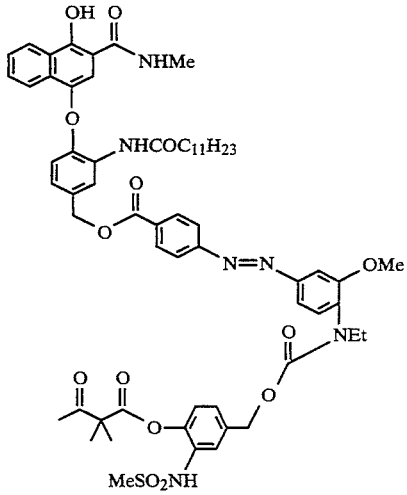

-continued (29)

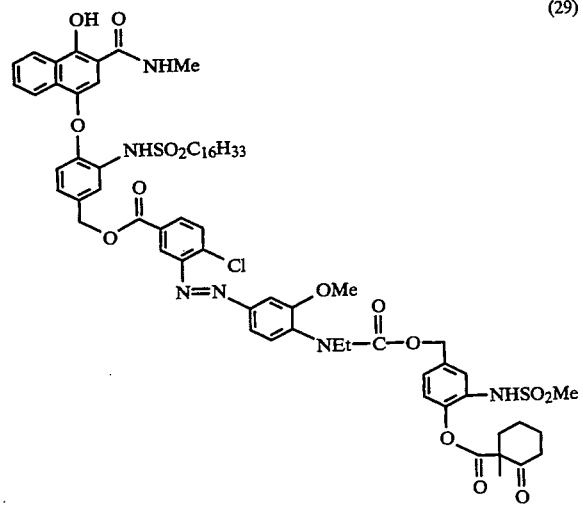

and (30)

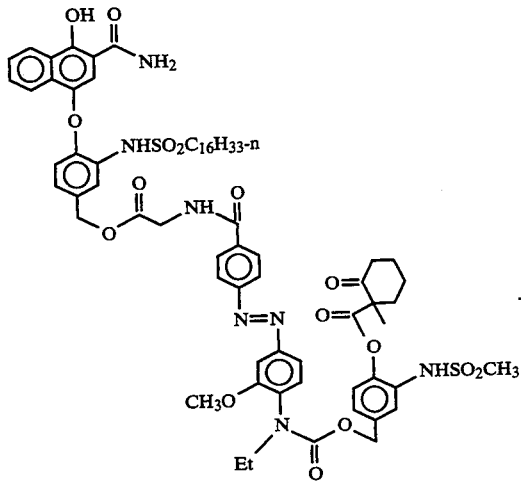

14. A process of forming a photographic image which comprises developing an exposed photographic silver halide emulsion layer with a color developing agent in the presence of a masking coupler as defined in claim 1.

15. A process as recited in claim 14, wherein the masking coupler is blocked as described in claim 2.

16. A process as recited in claim 14, wherein said LINK includes an oxygen heteroatom, —O—, to which said COUP is attached.

17. A process as recited in claim 15, wherein A and B are selected from the group consisting of phenyl, napthyl, thienyl, furyl, pyrrolyl, pyridyl, benzothienyl, indolyl, thiazolyl, benzothiazolyl and an oxazolyl group.

18. A process as recited in claim 17, wherein A and B comprise a phenyl group.

19. A process as recited in claim 15, wherein at least one of SOLA and SOLB are present and comprise a carboxyl group.

20. A photographic element as recited in claim 1, wherein at least one of the R's which is present is a blocking group and wherein the auxochromic nitrogen becomes unblocked during development.

21. A photographic element as recited in claim 20, wherein the blocking group has an electrophilic center.

22. A photographic element as recited in claim 21, wherein the blocking group is selected from the following:

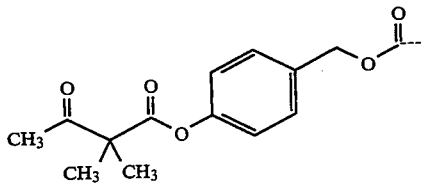

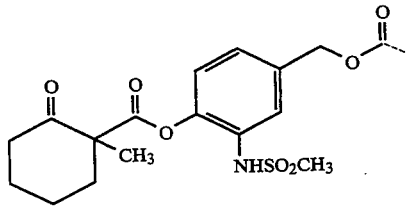

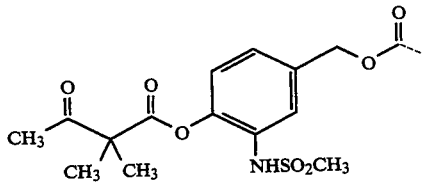

23. A photographic element as recited in claim 1, wherein at least one of f and i are 1.

24. A photographic element as recited in claim 1, wherein the LINK which is present comprises an oxygen heteroatom to which said COUP is attached.

25. A photographic element as recited in claim 1, wherein one of the R's is a blocking group and the other R is an alkyl group or a hydrogen atom.

26. A process as recited in claim 14, wherein the dye portion of the masking coupler is released and washed out of the film during processing.

27. A photographic element as recited in claim 1, wherein either the COUP moiety or the LINK to which it is attached are ballasted.

28. A photographic element as recited in claim 1, wherein COUP is ballasted such that the dye formed from COUP is a cyan dye.

29. A photographic element as recited in claim 1, wherein COUP is not ballasted, so that the COUP is a universal coupler.

30. A photographic element as recited in claim 1, wherein LINK is ballasted.

31. A photographic element as recited in claim 1, wherein the LINK is a ballasted quinone methide timing group.

32. A photographic element as recited in claim 1, wherein the COUP contains a ballast group and does not contain a solubilizing group.

* * * * *

UNITED STATES PATENT AND TRADEMARK OFFICE

CERTIFICATE OF CORRECTION

PATENT NO. : 5,364,745
DATED : November 15, 1994
INVENTOR(S) : Jared B. Mooberry, et al.

It is certified that error appears in the above-indentified patent and that said Letters Patent is hereby corrected as shown below:

Column 59, line 40 in the structure "$(SOLB)_1$" should read -- $(SOLB)_i$ --.

Column 63, line 50, "as described in claim 2" should be deleted.

Column 64, line 13, at the end of the structure omit "$\xi$" should read -- $\backslash$ --.

Signed and Sealed this

Thirtieth Day of May, 1995

Bruce Lehman

BRUCE LEHMAN

*Commissioner of Patents and Trademarks*

*Attest:*

*Attesting Officer*